US012543782B2

(12) United States Patent
Li et al.

(10) Patent No.: US 12,543,782 B2
(45) Date of Patent: Feb. 10, 2026

(54) ELECTRONIC ATOMIZATION HEATING E-LIQUID STORAGE ASSEMBLY AND ELECTRONIC ATOMIZATION HEATING DEVICE WITH IMPROVED HEATING EFFICIENCY

(71) Applicant: LUXSHARE PRECISION INDUSTRY CO., LTD., Shenzhen (CN)

(72) Inventors: Huabing Li, Shenzhen (CN); Zhongyuan Lai, Shenzhen (CN); Yu Huang, Shenzhen (CN)

(73) Assignee: LUXSHARE PRECISION INDUSTRY CO., LTD., Shenzhen (CN)

( * ) Notice: Subject to any disclaimer, the term of this patent is extended or adjusted under 35 U.S.C. 154(b) by 668 days.

(21) Appl. No.: 17/944,875

(22) Filed: Sep. 14, 2022

(65) Prior Publication Data

US 2023/0284685 A1 Sep. 14, 2023

(30) Foreign Application Priority Data

Mar. 8, 2022 (CN) ..... 202210227224.0

(51) Int. Cl.
*A24F 40/40* (2020.01)
*A24F 40/10* (2020.01)
*A24F 40/50* (2020.01)

(52) U.S. Cl.
CPC ..... *A24F 40/40* (2020.01); *A24F 40/10* (2020.01); *A24F 40/50* (2020.01)

(58) Field of Classification Search
None
See application file for complete search history.

(56) References Cited

U.S. PATENT DOCUMENTS

2018/0242638 A1 8/2018 Godfrey et al.
2019/0165515 A1* 5/2019 Sano ..... H01R 13/6278
(Continued)

FOREIGN PATENT DOCUMENTS

CN 201638985 U 11/2010
CN 203952433 U 11/2014
(Continued)

OTHER PUBLICATIONS

CN-209769002-U, English machine translation (Year: 2019).*

*Primary Examiner* — Michael H. Wilson
*Assistant Examiner* — Michael T Fulton
(74) *Attorney, Agent, or Firm* — Birch, Stewart, Kolasch & Birch, LLP

(57) ABSTRACT

An electronic atomization heating e-liquid storage assembly includes a second housing, an e-liquid tank housing, an e-liquid storage element, an e-liquid guiding element and a heating element. The second housing has a second receiving space. The e-liquid tank housing is detachably received in the second receiving space. The e-liquid storage element is received in the e-liquid tank housing. The e-liquid guiding element is in contact with the e-liquid storage element. The heating element includes a heating portion used to heat e-liquid adsorbed in the e-liquid guiding element into a gaseous state, thereby avoiding heating the entire e-liquid and improving the heating efficiency. The present disclosure also discloses an electronic atomization heating device having the electronic atomization heating e-liquid storage assembly.

3 Claims, 22 Drawing Sheets

(56) References Cited

U.S. PATENT DOCUMENTS

| | | | | |
|---|---|---|---|---|
| 2020/0323272 | A1 | 10/2020 | Zhu | |
| 2021/0022403 | A1 * | 1/2021 | Korus | A61M 15/06 |

FOREIGN PATENT DOCUMENTS

| | | | | | |
|---|---|---|---|---|---|
| CN | 104585886 | A | | 5/2015 | |
| CN | 205863455 | U | | 1/2017 | |
| CN | 206453255 | U | | 9/2017 | |
| CN | 107802037 | A | | 3/2018 | |
| CN | 109419936 | A | | 3/2019 | |
| CN | 208941042 | U | | 6/2019 | |
| CN | 209677707 | U | | 11/2019 | |
| CN | 209769002 | U | * | 12/2019 | A24F 40/10 |
| CN | 111109682 | A | | 5/2020 | |
| CN | 112806615 | A | | 5/2021 | |
| CN | 112931973 | A | | 6/2021 | |
| CN | 213604377 | U | | 7/2021 | |
| CN | 113841930 | A | | 12/2021 | |
| CN | 215224775 | U | | 12/2021 | |
| CN | 215873447 | U | | 2/2022 | |
| CN | 215913307 | U | | 3/2022 | |
| CN | 114668180 | A | | 6/2022 | |
| TW | 202126196 | A | | 7/2021 | |
| TW | M623269 | U | | 2/2022 | |
| WO | WO 2019/105249 | A1 | | 6/2019 | |
| WO | WO 2019/232086 | A1 | | 12/2019 | |

* cited by examiner

ELECTRONIC ATOMIZATION HEATING E-LIQUID STORAGE ASSEMBLY AND ELECTRONIC ATOMIZATION HEATING DEVICE WITH IMPROVED HEATING EFFICIENCY

CROSS-REFERENCE TO RELATED APPLICATION

This patent application claims priority of a Chinese Patent Application No. 202210227224.0, filed on Mar. 8, 2022 and titled "ELECTRONIC ATOMIZATION HEATING E-LIQUID STORAGE ASSEMBLY AND ELECTRONIC ATOMIZATION HEATING DEVICE", the entire content of which is incorporated herein by reference.

TECHNICAL FIELD

The present disclosure relates to an electronic atomization heating e-liquid storage assembly and an electronic atomization heating device, which belongs to a technical field of electronic atomization heating.

BACKGROUND

The electronic atomization heating device (e.g., an electronic cigarette) in the related art includes a battery, a battery management module, a control module, an e-liquid tank housing, a heating element, and the like. The e-liquid tank housing is adapted to store e-liquid. The heating element is adapted to heat the e-liquid to make it gaseous. However, during heating, the heating element heats the entire e-liquid at the same time, which results in lower heating efficiency.

SUMMARY

An object of the present disclosure is to provide an electronic atomization heating e-liquid storage assembly and an electronic atomization heating device which are easy to disassemble and have high heating efficiency.

In order to achieve the above object, the present disclosure adopts the following technical solution: an electronic atomization heating e-liquid storage assembly, including: a second housing having a second receiving space; an e-liquid tank housing detachably received in the second receiving space; an e-liquid storage element adapted to store e-liquid, the e-liquid storage element being received in the e-liquid tank housing; an e-liquid guiding element being in contact with the e-liquid storage element, the e-liquid guiding element being adapted to guide and adsorb the e-liquid derived from the e-liquid storage element; and a heating element including a heating portion, the heating portion being adapted to heat the e-liquid adsorbed in the e-liquid guiding element into a gaseous state.

In order to achieve the above object, the present disclosure adopts the following technical solution: an electronic atomization heating device, including: an electronic atomization heating battery assembly; and the electronic atomization heating e-liquid storage assembly; the electronic atomization heating battery assembly including: a first housing having a first receiving space; a battery accommodating housing received in the first receiving space, the battery accommodating housing having an accommodating space; a battery detachably received in the accommodating space of the battery accommodating housing; a battery management module located at one end of the battery; a control module located at another end of the battery; and a connecting member, the battery management module and the control module being electrically connected to the connecting member; wherein the electronic atomization heating battery assembly and the electronic atomization heating e-liquid storage assembly are mated with each other.

Compared with the prior art, the present disclosure is provided with an e-liquid storage element and an e-liquid guiding element. The heating portion of the heating element is adapted to heat the e-liquid adsorbed in the e-liquid guiding element into a gaseous state, thereby avoiding heating the entire e-liquid and improving the heating efficiency.

DETAILED DESCRIPTION

Figure 1:
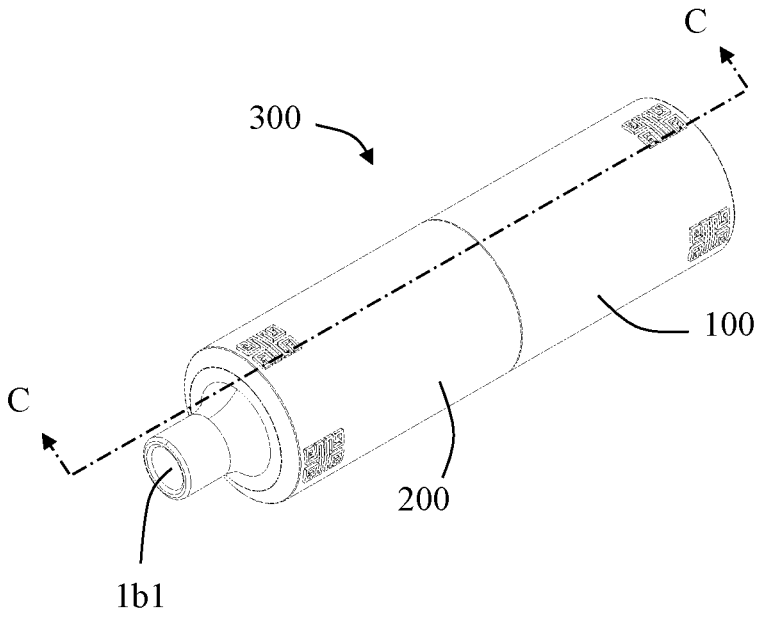
FIG. 1 is a schematic perspective view of an electronic atomization heating device in accordance with an embodiment of the present disclosure.
Figure 2:
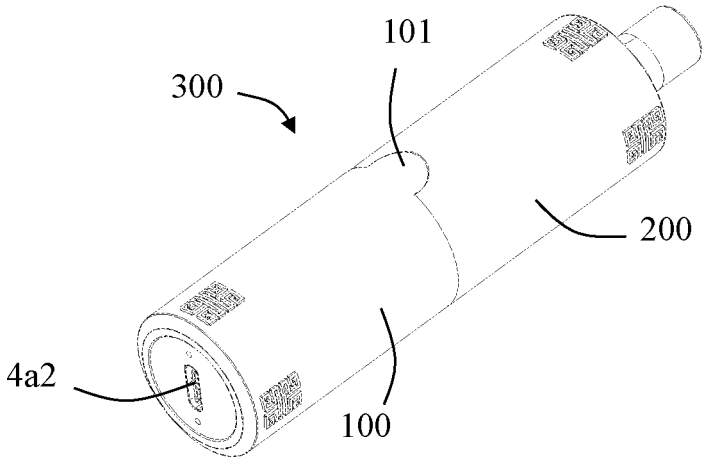
FIG. 2 is a perspective schematic view of FIG. 1 from another angle.
Figure 3:
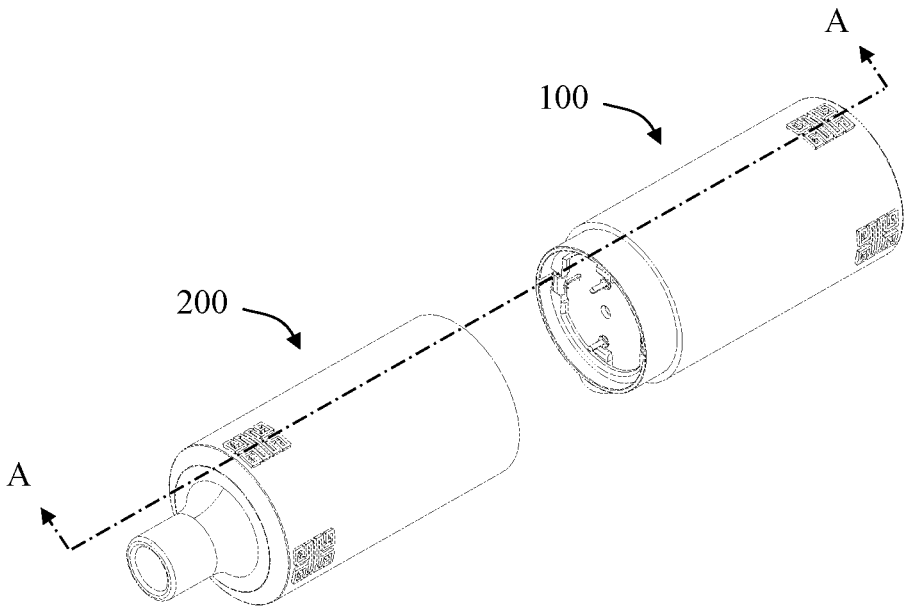
FIG. 3 is a partially exploded perspective view of FIG. 1, wherein an electronic atomization heating battery assembly and an electronic atomization heating e-liquid storage assembly are separated from each other.
Figure 4:
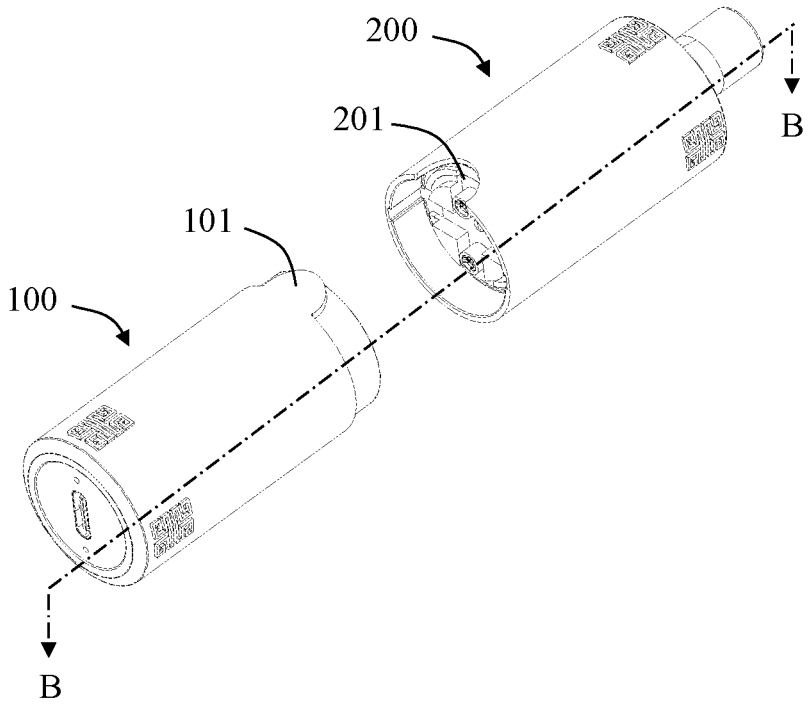
FIG. 4 is the partial perspective exploded view of FIG. 3 from another angle.

Exemplary embodiments will be described in detail here, examples of which are shown in drawings. When referring to the drawings below, unless otherwise indicated, same numerals in different drawings represent the same or similar elements. The examples described in the following exemplary embodiments do not represent all embodiments consistent with this application. Rather, they are merely examples of devices and methods consistent with some aspects of the application as detailed in the appended claims.

The terminology used in this application is only for the purpose of describing particular embodiments, and is not intended to limit this application. The singular forms "a", "said", and "the" used in this application and the appended claims are also intended to include plural forms unless the context clearly indicates other meanings.

It should be understood that the terms "first", "second" and similar words used in the specification and claims of this application do not represent any order, quantity or importance, but are only used to distinguish different components. Similarly, "an" or "a" and other similar words do not mean a quantity limit, but mean that there is at least one; "multiple" or "a plurality of" means two or more than two. Unless otherwise noted, "front", "rear", "lower" and/or "upper" and similar words are for ease of description only and are not limited to one location or one spatial orientation. Similar words such as "include" or "comprise" mean that elements or objects appear before "include" or "comprise" cover elements or objects listed after "include" or "comprise" and their equivalents, and do not exclude other elements or objects. The term "a plurality of" mentioned in the present disclosure includes two or more.

Hereinafter, some embodiments of the present disclosure will be described in detail with reference to the accompanying drawings. In the case of no conflict, the following embodiments and features in the embodiments can be combined with each other.

Referring to FIGS. 1 to 4, the present disclosure discloses an electronic atomization heating device 300 which includes an electronic atomization heating battery assembly 100 and an electronic atomization heating e-liquid storage assembly 200. The electronic atomization heating battery assembly 100 and the electronic atomization heating e-liquid storage assembly 200 are connected to each other. In an embodiment of the present disclosure, one of the electronic atomization heating battery assembly 100 and the electronic atomization heating e-liquid storage assembly 200 is provided with an engaging protrusion 101, and a remaining one of the electronic atomization heating battery assembly 100 and the electronic atomization heating e-liquid storage assembly 200 is provided with an engaging recess 201. The precise assembly of the electronic atomization heating battery assembly 100 and the electronic atomization heating e-liquid storage assembly 200 is achieved through the mating of the engaging protrusion 101 and the engaging recess 201.

Referring to FIGS. 5 to 12, in the embodiment shown in the present disclosure, the electronic atomization heating battery assembly 100 includes a first housing 1*a*, a battery accommodating housing 2*a* detachably received in the first housing 1*a*, a battery 3*a* detachably received in the battery accommodating housing 2*a*, a battery management module 4*a* detachably installed on one end (e.g., a bottom end) of the battery 3*a*, a battery fixing and sealing cover 5*a* detachably fixing one end (e.g., the bottom end) of the battery 3*a* in the battery accommodating housing 2*a*, an elastic gasket 6*a* detachably mounted on another end (e.g., a top end) of the battery 3*a*, an anti-loosening member 7*a* located at one end (e.g., the top end) of the battery accommodating housing 2*a*, a control module 8*a* detachably mounted on another end (e.g., a top end) of the battery accommodating housing 2*a*, and a connecting member 9*a* electrically connecting the battery management module 4*a* and the control module 8*a*. The control module 8*a* may be an MCU (Microcontroller Unit) control module.

Figure 5:
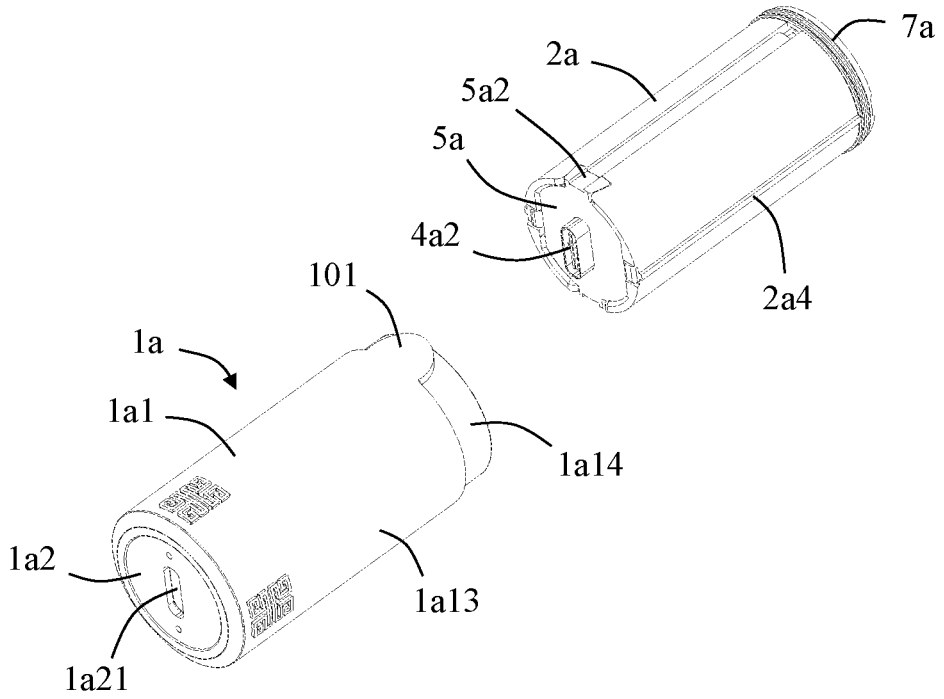
FIG. 5 is a partial perspective exploded view of the electronic atomization heating battery assembly in FIG. 4, wherein a first housing is separated.
Figure 6:
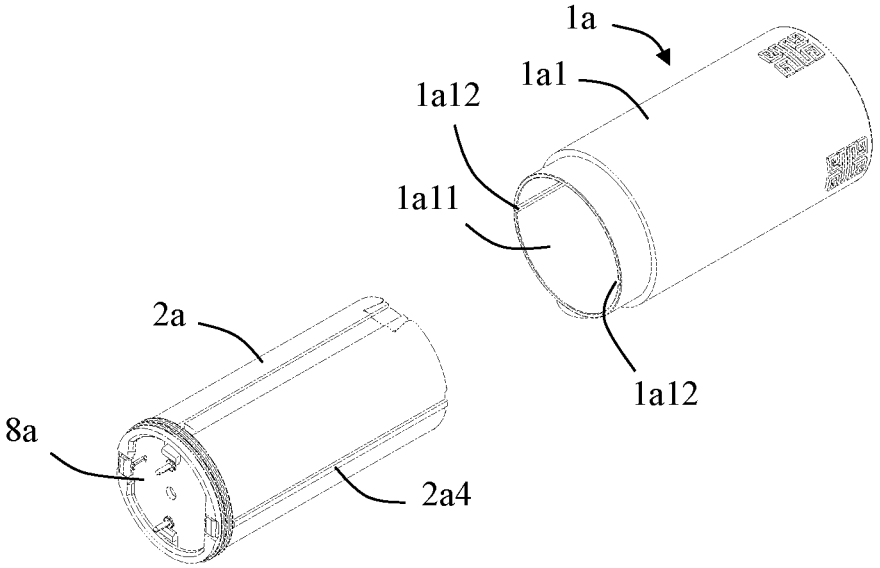
FIG. 6 is a partial perspective exploded view of FIG. 5 from another angle.

Referring to FIG. 5 and FIG. 6, in the embodiment shown in the present disclosure, the first housing 1*a* includes a cylindrical first circumferential wall 1*a*1 and a first bottom wall 1*a*2 located at the bottom of the first circumferential wall 1*a*1. The first circumferential wall 1*a*1 is enclosed to form a first receiving space 1*a*11 for receiving the battery accommodating housing 2*a*. The first receiving space 1*a*11 is of a substantially cylindrical configuration and opens upwardly. An inner side of the first circumferential wall 1*a*1 further defines a plurality of positioning grooves 1*a*12. In the illustrated embodiment of the present disclosure, each positioning groove 1*a*12 extends along an axial direction of the first circumferential wall 1*a*1. Preferably, the plurality of positioning grooves 1*a*12 are evenly distributed along a circumferential direction of the first circumferential wall 1*a*1. The first bottom wall 1*a*2 includes a first slot 1*a*21 which communicates with the first receiving space Tall and extends downwardly through the first bottom wall 1*a*2.

In the embodiment shown in the present disclosure, the first circumferential wall 1*a*1 includes a first main body portion 1*a*13, and a first constricted portion 1*a*14 connected to the first main body portion 1*a*13 and located at the top of the first main body portion 1*a*13. An outer diameter of the first constricted portion 1*a*14 is smaller than an outer diameter of the first main body portion 1*a*13 so as to form a step. The first constricted portion 1*a*14 is adapted for being inserted into the electronic atomization heating e-liquid storage assembly 200. The engaging protrusion 101 is connected to the first main body portion 1*a*13. The engaging protrusion 101 protrudes to an outer surface of the first constricted portion 1*a*14 along the axial direction of the first circumferential wall 1*a*1.

Figure 7:
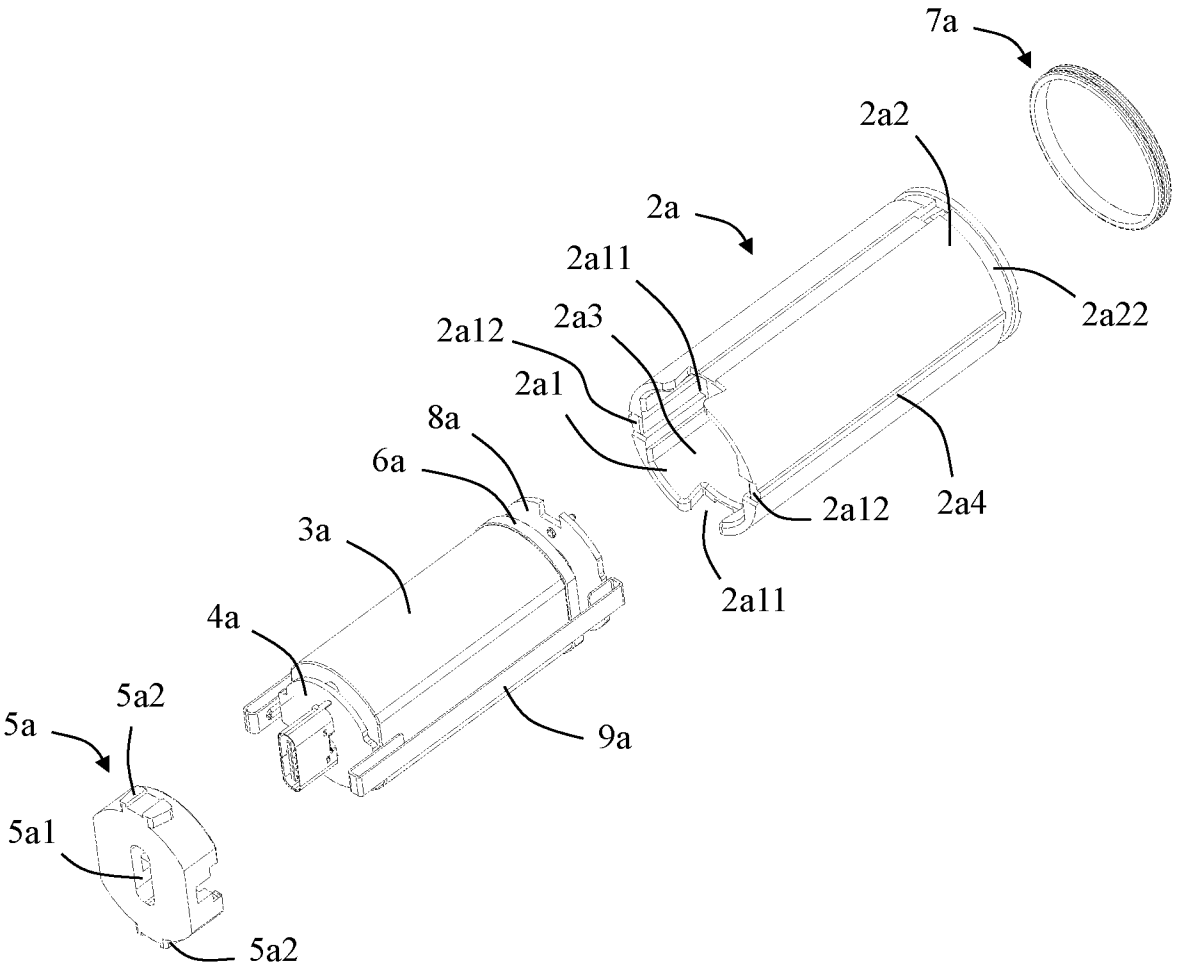
FIG. 7 is a partially exploded perspective view after removing a battery accommodating housing in FIG. 5.
Figure 8:
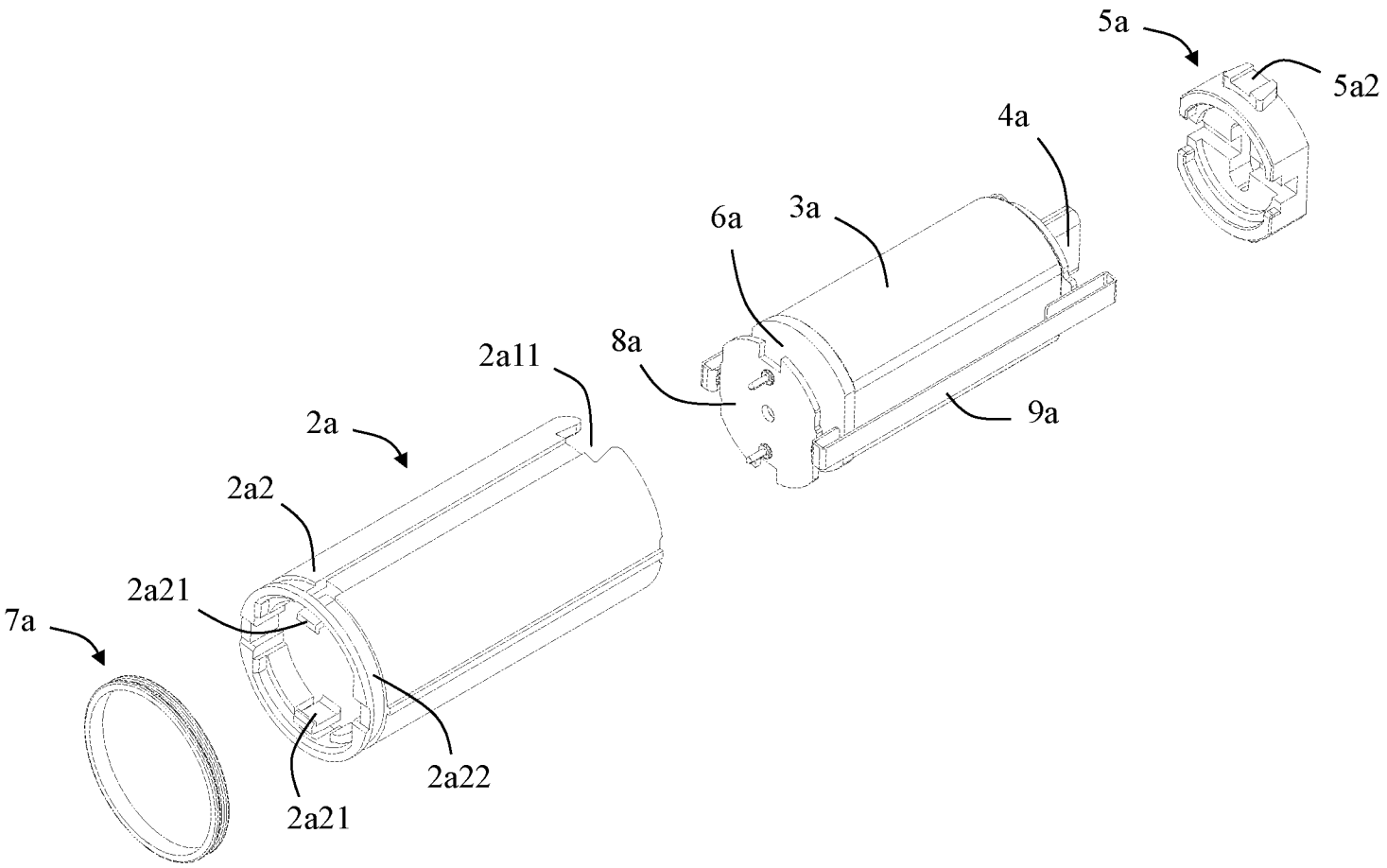
FIG. 8 is a partially exploded perspective view of FIG. 7 from another angle.

Referring to FIG. 7 and FIG. 8, the battery accommodating housing 2*a* is also of a substantially cylindrical configuration. The battery accommodating housing 2*a* includes a first end portion 2*a*1, a second end portion 2*a*2 opposite to the first end portion 2*a*1, and an accommodating space 2*a*3 for accommodating the battery 3*a*. In the embodiment shown in the present disclosure, the first end portion 2*a*1 is a lower end portion, and the second end portion 2*a*2 is an upper end portion. An outer surface of the battery accommodating housing 2*a* is provided with a plurality of positioning ribs 2*a*4. Each positioning rib 2*a*4 extends along the axial direction. The positioning ribs 2*a*4 are used to be inserted into corresponding positioning grooves 1*a*12 along the axial direction. The first end portion 2*a*1 is further provided with a pair of first recesses 2*a*11 recessed toward the second end portion 2*a*2 and a pair of second recesses 2*a*12 recessed toward the second end portion 2*a*2. The pair of first recesses 2*a*11 are distributed along a first direction (e.g., a top-bottom direction). The pair of second recesses 2a12 are distributed along a second direction (e.g., a left-right direction). The second end portion 2a2 is provided with an elastic locking arm 2a21 located on an inner side of the battery accommodating housing 2a. The elastic locking arm 2a21 includes a hook portion protruding inwardly into the accommodating space 2a3. In the embodiment of the present disclosure, at least two elastic locking arms 2a21 are provided, and they are evenly distributed on the inner side of the battery accommodating housing 2a. In addition, an outer surface of the second end portion 2a2 is further provided with an annular groove 2a22. The annular groove 2a22 is adapted to receive the anti-loosing member 7a. In an embodiment of the present disclosure, the anti-loosing member 7a may be soft glue. In other embodiments of the present disclosure, the anti-loosing member 7a may also be a sealing ring or the like.

Figure 9:
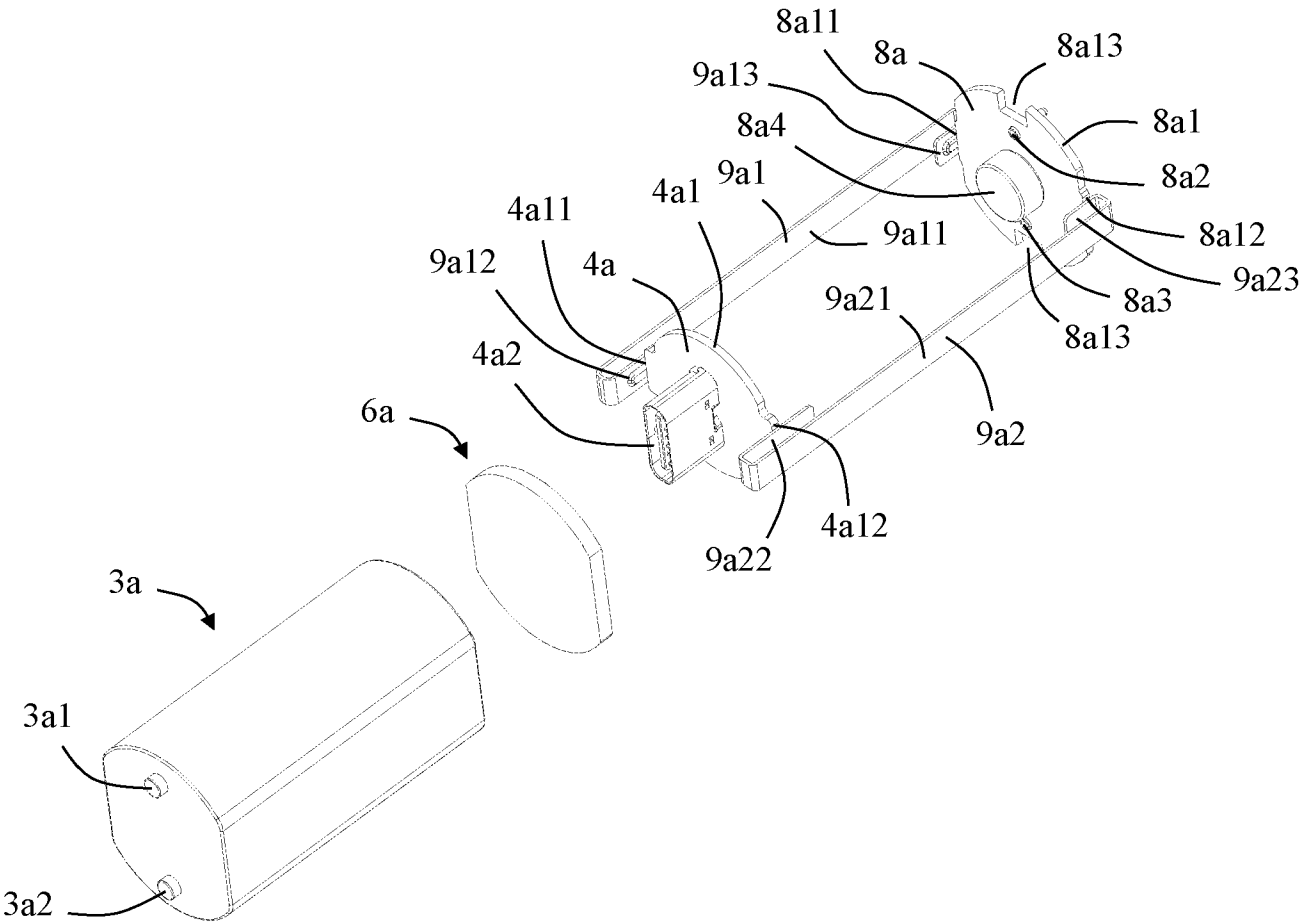
FIG. 9 is a partially exploded perspective view of a battery fixing and sealing cover, the battery accommodating housing and an anti-loosening member in FIG. 7.

Referring to FIG. 9, the battery 3a includes a first pole 3a1 and a second pole 3a2 which are located at one end (e.g., the bottom end) of the battery 3a, wherein one of the first pole 3a1 and the second pole 3a2 is a positive electrode, and a remaining one of the first pole 3a1 and the second pole 3a2 is a negative electrode.

Referring to FIGS. 9 to 12, the battery management module 4a includes a first circuit board 4a1 and an electrical connector 4a2 mounted to the first circuit board 4a1. The first circuit board 4a1 includes a first contact element 4a11 and a second contact element 4a12. The electrical connector 4a2 is electrically connected to the first circuit board 4a1. The electrical connector 4a2 serves as a charging port of the electronic atomization heating battery assembly 100. In the embodiment shown in the present disclosure, the electrical connector 4a2 is a USB Type C connector. The first pole 3a1 and the second pole 3a2 of the battery 3a are in abutment with the first circuit board 4a1 for electrical connection. In the embodiment shown in the present disclosure, the first contact element 4a11 and the second contact element 4a12 are both conductive pads. The first contact element 4a11 and the second contact element 4a12 are disposed opposite to each other and protrude laterally from edges of the first circuit board 4a1, respectively. In the embodiment shown in the present disclosure, the first contact element 4a11 and the second contact element 4a12 are received in the pair of second recesses 2a12 for positioning.

Referring to FIGS. 5, 7 and 8, the battery fixing and sealing cover 5a is at least partially received in the accommodating space 2a3 so that the battery fixing and sealing cover 5a is assembled and fixed to the first end portion 2a1 of the battery accommodating housing 2a. The battery fixing and sealing cover 5a includes a through hole Sal for allowing the electrical connector 4a2 to pass through and protruding portions 5a2 protruding from edges of the battery fixing and sealing cover 5a in the top-bottom direction, respectively. The protruding portions 5a2 are received in the pair of first recesses 2a11 for positioning. In the illustrated embodiment of the present disclosure, at least two protruding portions 5a2 are provided, and they are evenly spaced and arranged on an edge of the battery fixing and sealing cover 5a. Both the protruding portions 5a2 and the first recesses 2a11 are wedge-shaped, so that when the protruding portions 5a2 are assembled into the first recesses 2a11 through deformation, the battery fixing and sealing cover 5a can be prevented from falling off from the battery accommodating housing 2a.

The elastic gasket 6a is made of non-conductive elastic EVA or soft glue. The elastic gasket 6a is in abutment with another end of the battery 3a. Another end of the battery 3a is an end of the battery 3a opposite to the first pole 3a1 and the second pole 3a2. The elastic gasket 6a can provide a certain buffer to the battery 3a.

Referring to FIGS. 8 to 12, the control module 8a includes a second circuit board 8a1, a first mating terminal 8a2 and a second mating terminal 8a3 which are electrically connected to the second circuit board 8a1, and an airflow sensing/power control integrated element 8a4. The airflow sensing/power control integrated element 8a4 is fixed to the second circuit board 8a1 and abuts against the elastic gasket 6a. The second circuit board 8a1 is provided with an escape slot 8a13 corresponding to the elastic locking arm 2a21 of the battery accommodating housing 2a. After the second circuit board 8a1 is assembled in place, the elastic locking arm 2a21 passes through the corresponding escape slot 8a13, so that the hook portion of the elastic locking arm 2a21 is locked with the second circuit board 8a1. In the embodiment of the present disclosure, the elastic locking arms 2a21 and the escape slots 8a13 have the same number and one-to-one correspondence. Both the elastic locking arms 2a21 and the escape slots 8a13 are evenly spaced apart, so that the force can be evenly applied to prevent loosening. The second circuit board 8a1 includes a third contact element 8a11 and a fourth contact element 8a12. In the embodiment shown in the present disclosure, the third contact element 8a11 and the fourth contact element 8a12 are both conductive pads. The third contact element 8a11 and the fourth contact element 8a12 are disposed opposite to each other, and protrude laterally from edges of the second circuit board 8a1, respectively.

Figure 10:
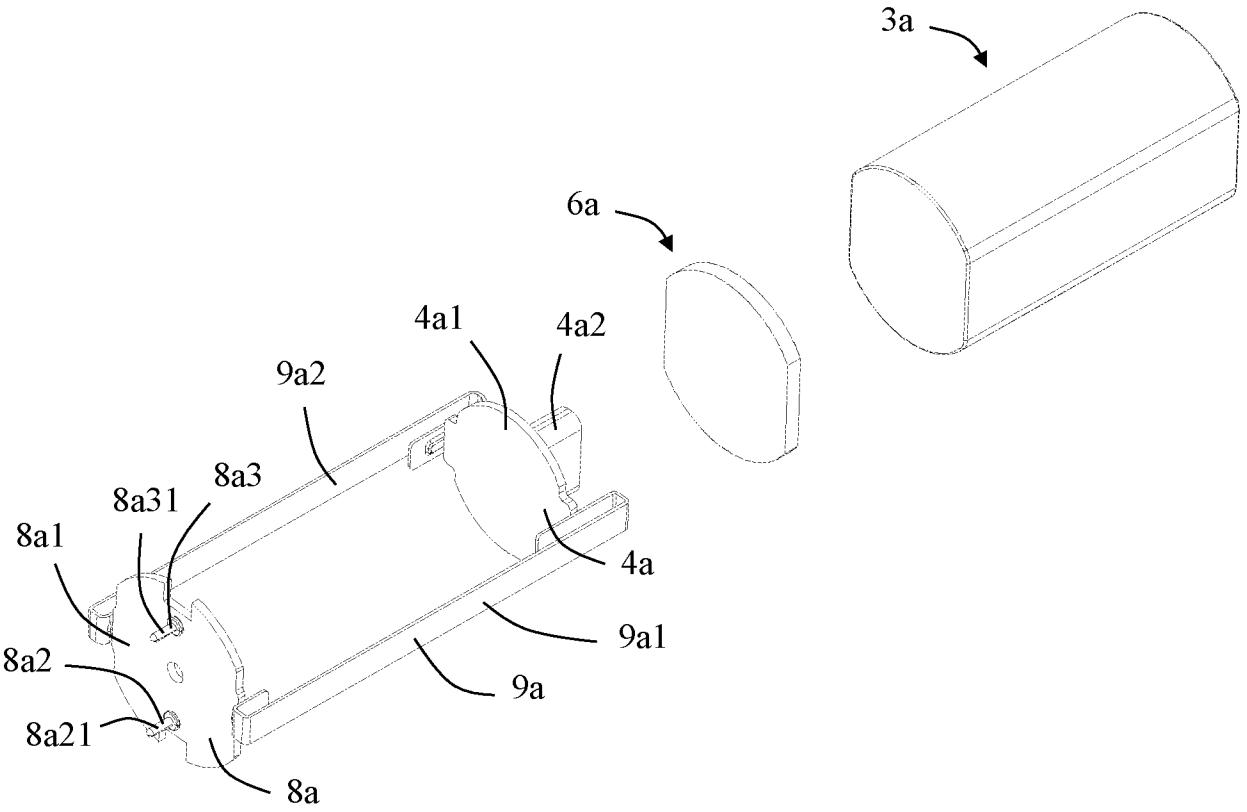
FIG. 10 is a partial perspective exploded view of FIG. 9 from another angle.
Figure 11:
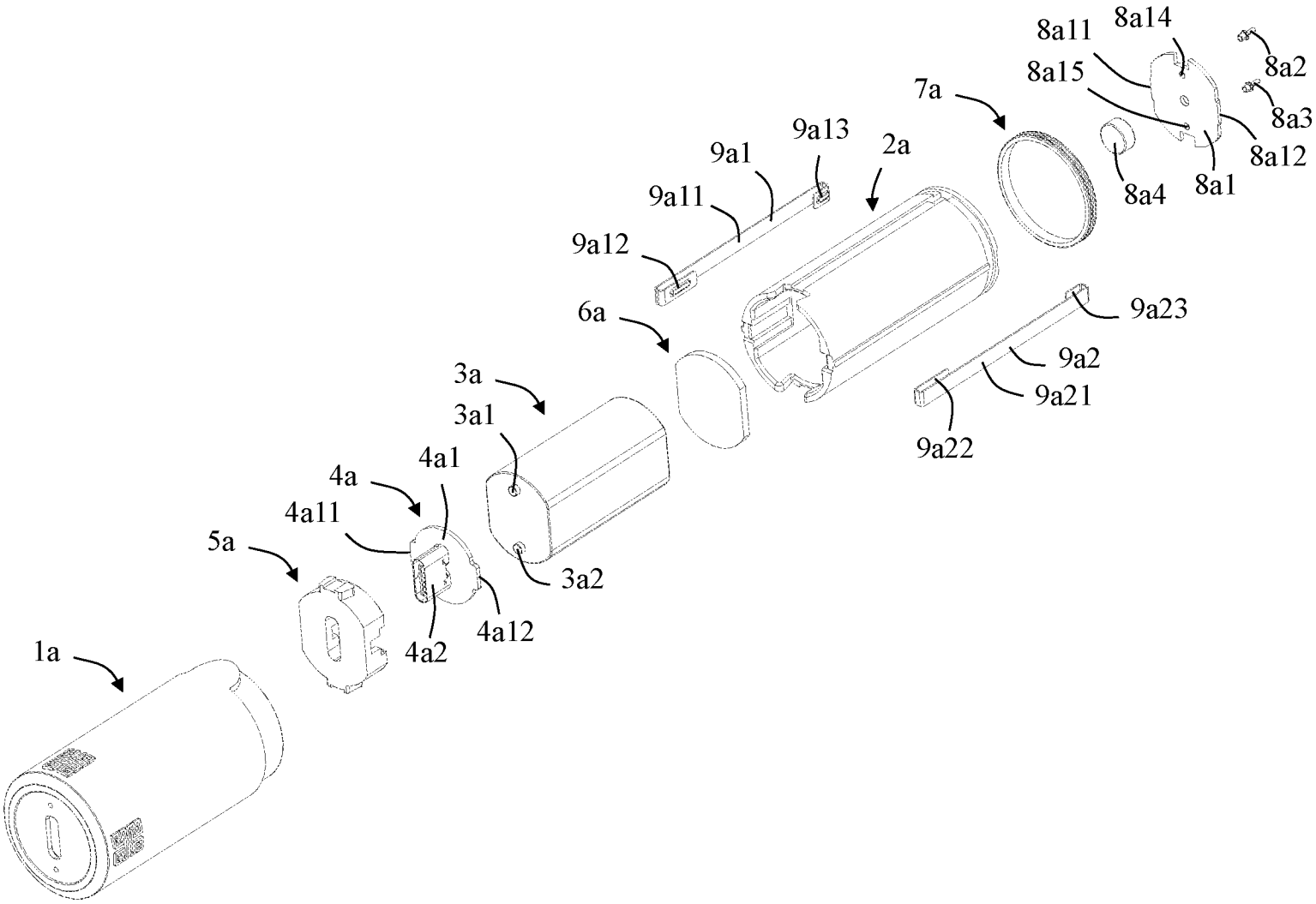
FIG. 11 is an exploded perspective view of the electronic atomization heating battery assembly in accordance with the embodiment of the present disclosure.
Figure 12:
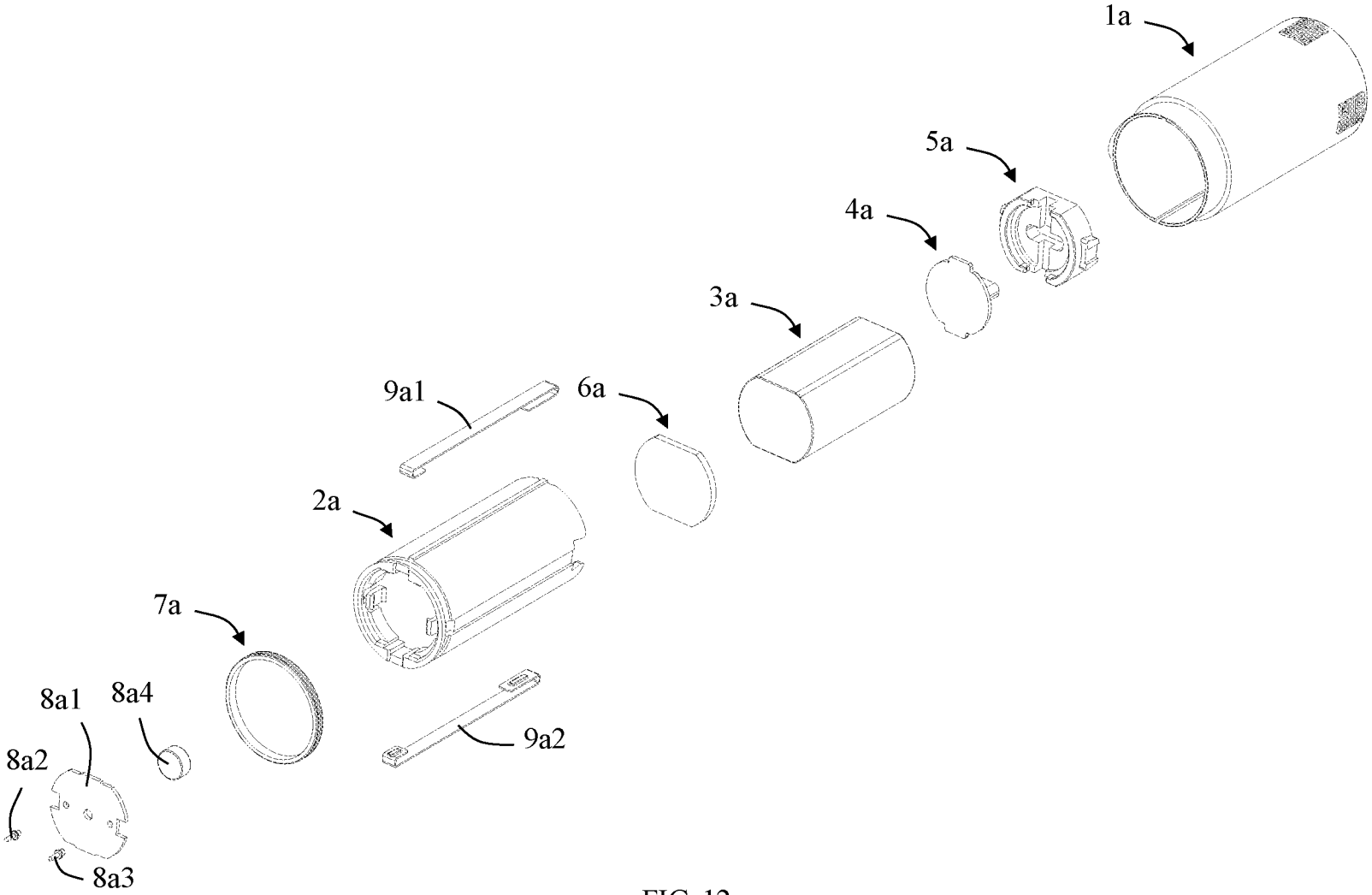
FIG. 12 is a perspective exploded view of FIG. 11 from another angle.
Figure 13:
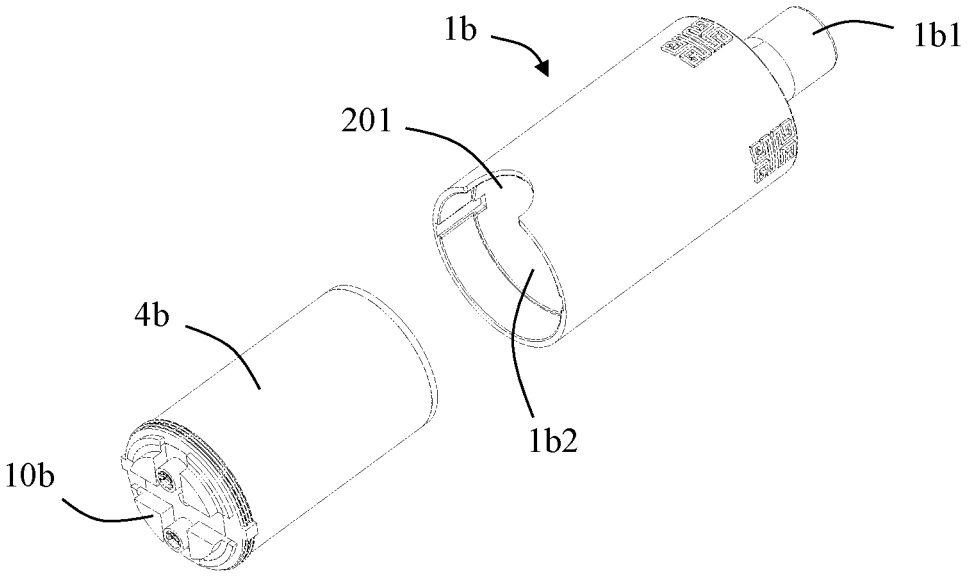
FIG. 13 is a partially exploded perspective view of the electronic atomization heating e-liquid storage assembly in FIG. 4, wherein a second housing is separated.
Figure 14:
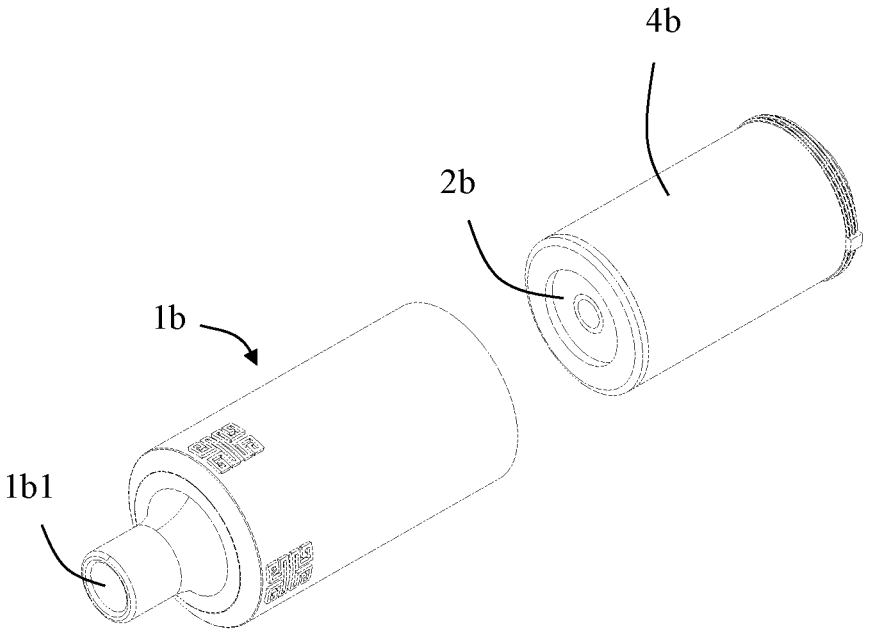
FIG. 14 is a partially exploded perspective view of FIG. 13 from another angle.
Figure 15:
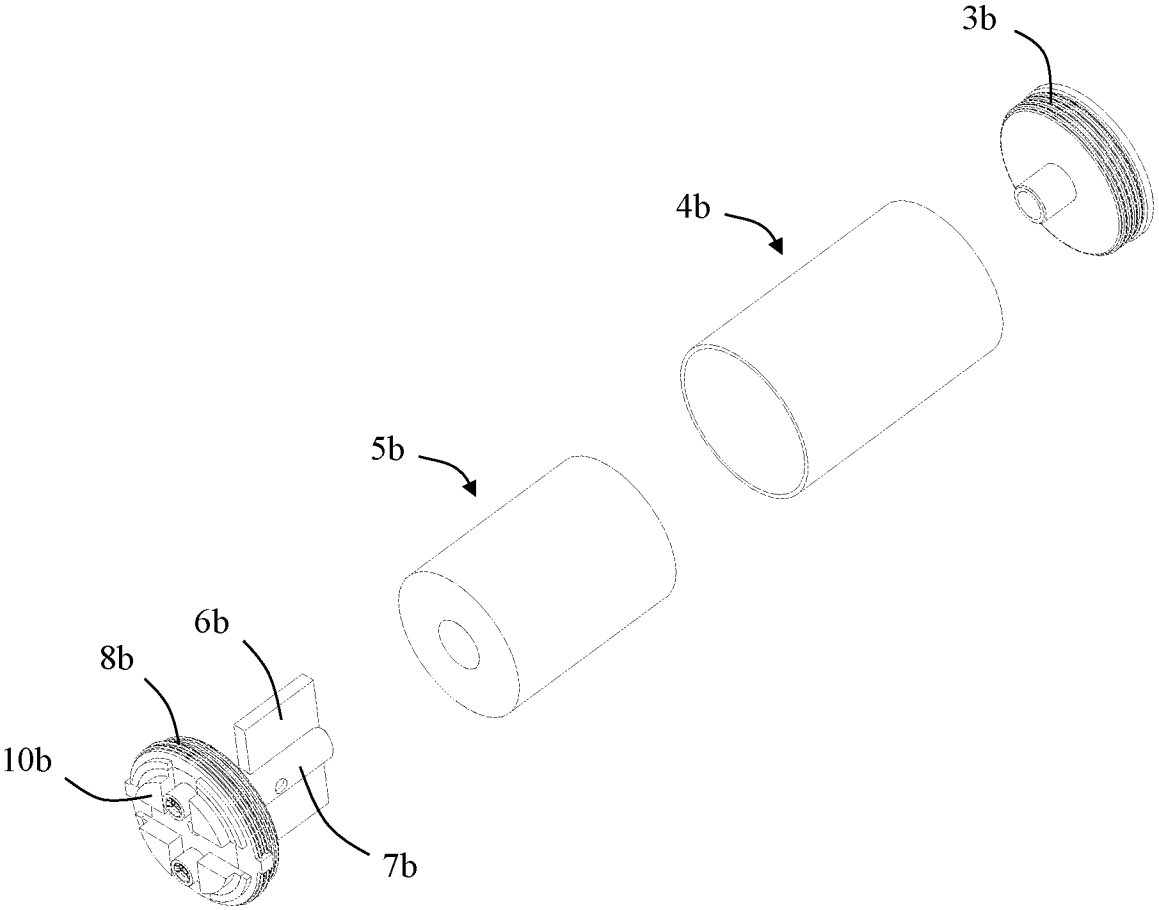
FIG. 15 is a partially exploded perspective view after removing the second housing in FIG. 13.
Figure 16:
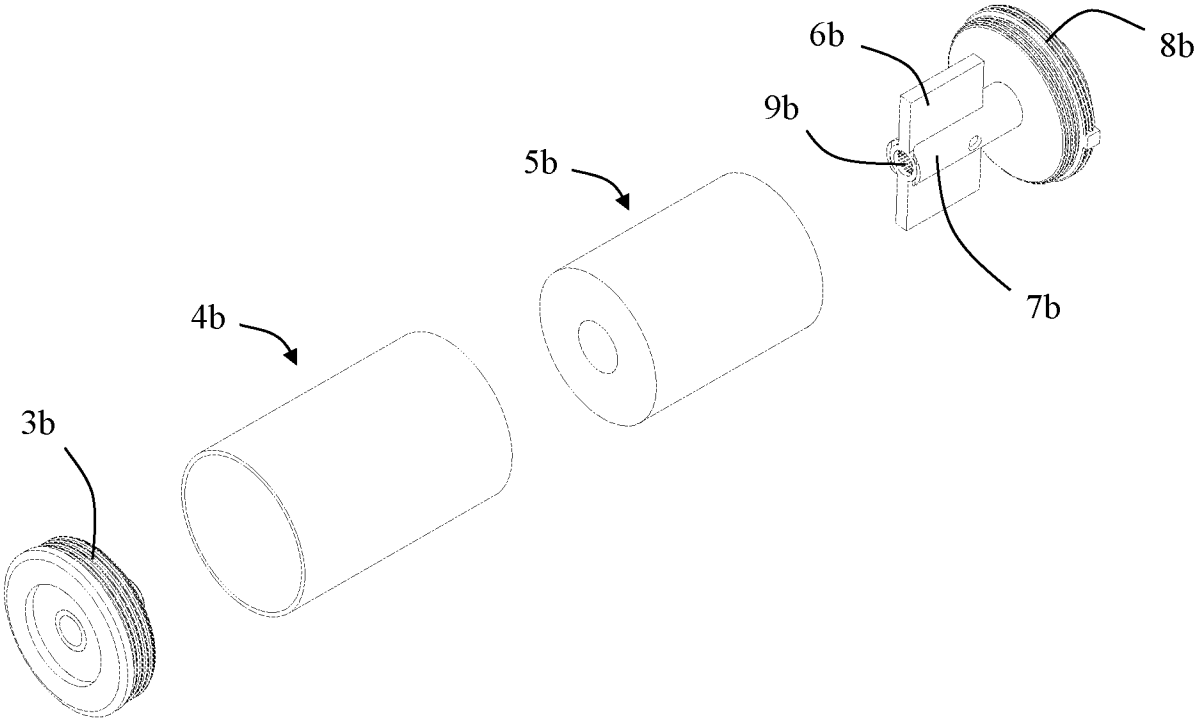
FIG. 16 is a partially exploded perspective view of FIG. 15 from another angle.
Figure 17:
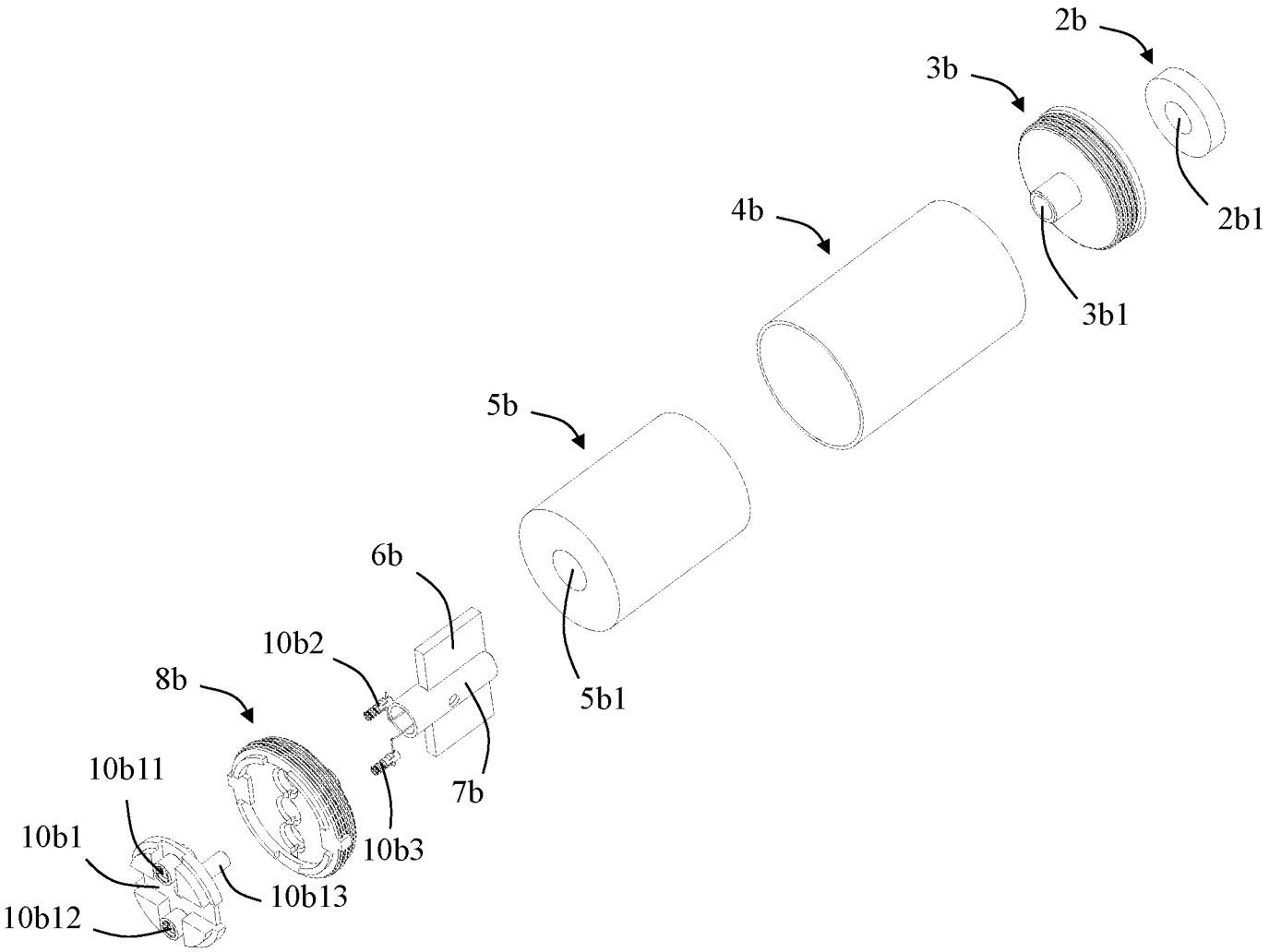
FIG. 17 is a further partial perspective exploded view of FIG. 15.
Figure 18:
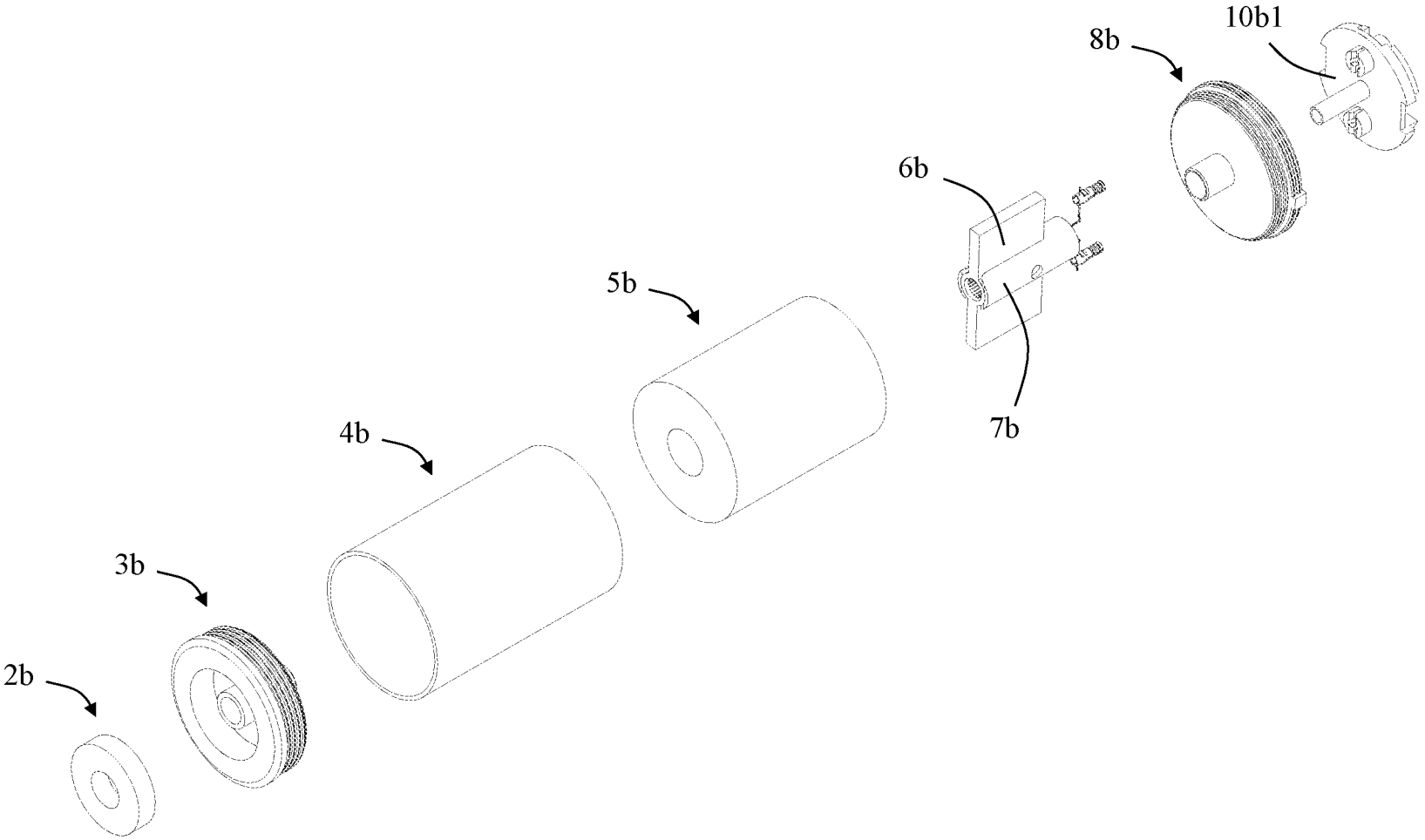
FIG. 18 is a partially exploded perspective view of FIG. 17 from another angle.
Figure 19:
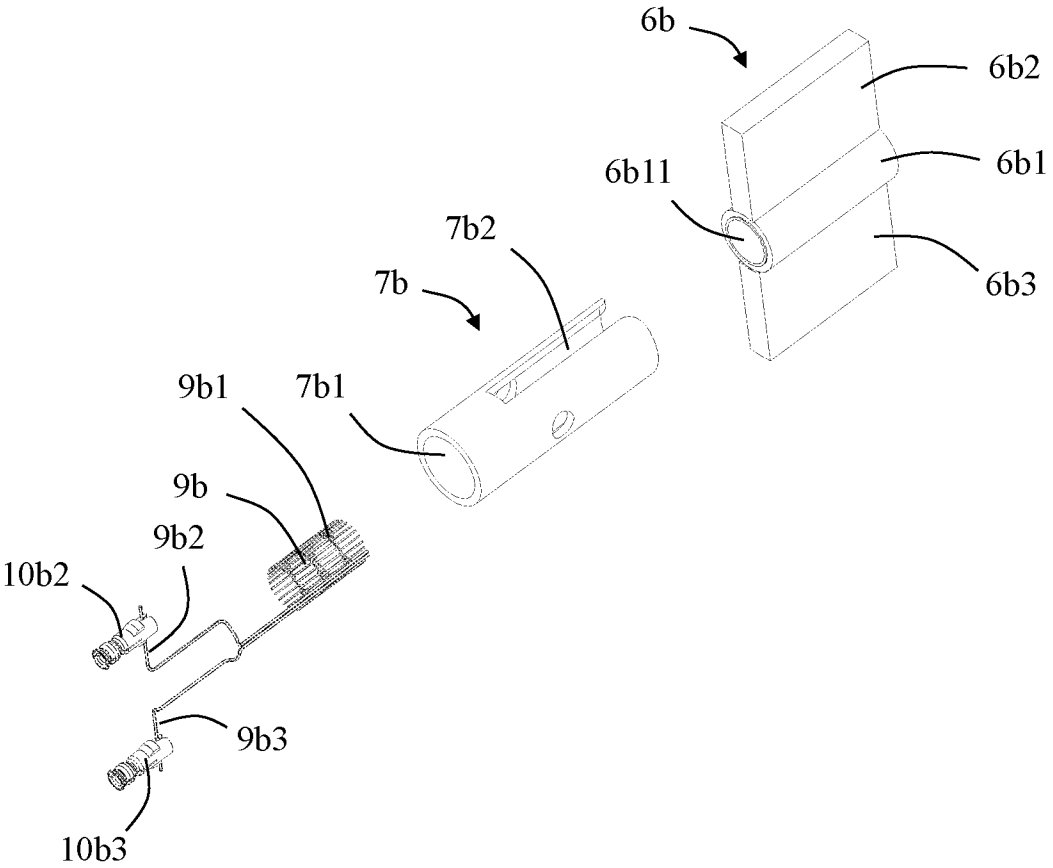
FIG. 19 is an exploded perspective view of a first contact terminal, a second contact terminal, a heating element, an e-liquid absorbing element and a clamping pipe in FIG. 17.
Figure 20:
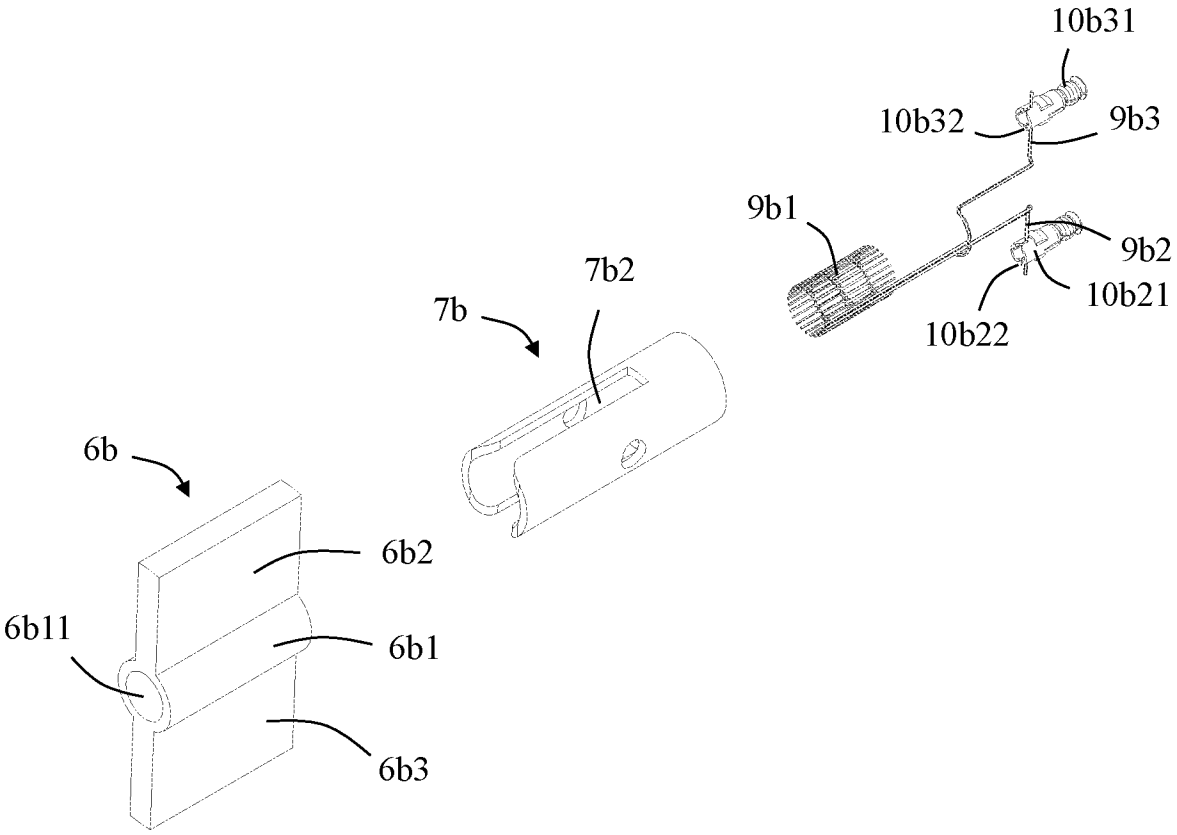
FIG. 20 is a perspective exploded view of FIG. 19 from another angle.
Figure 21:
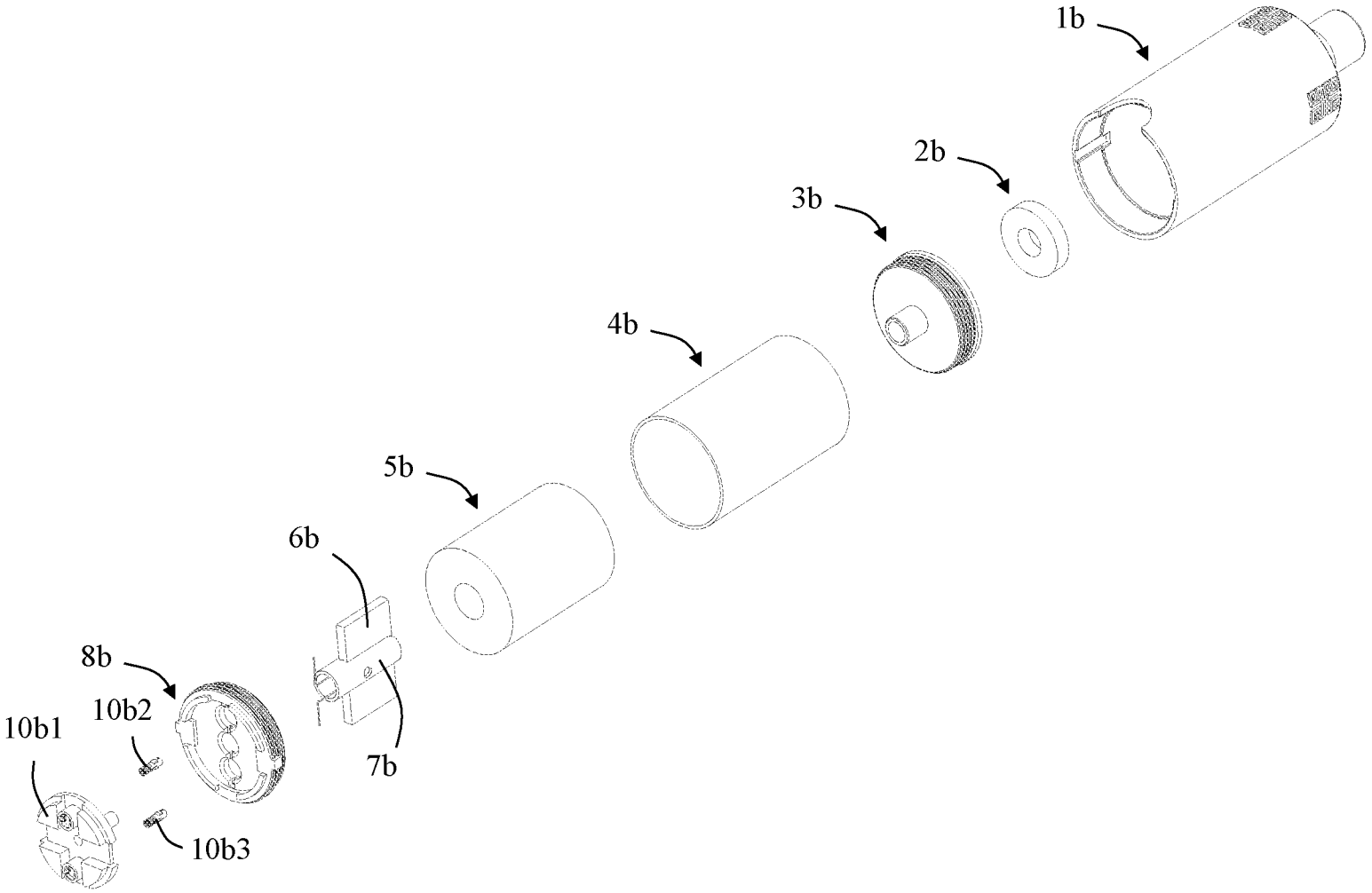
FIG. 21 is a perspective exploded view of the electronic atomization heating e-liquid storage assembly in FIG. 4.
Figure 22:
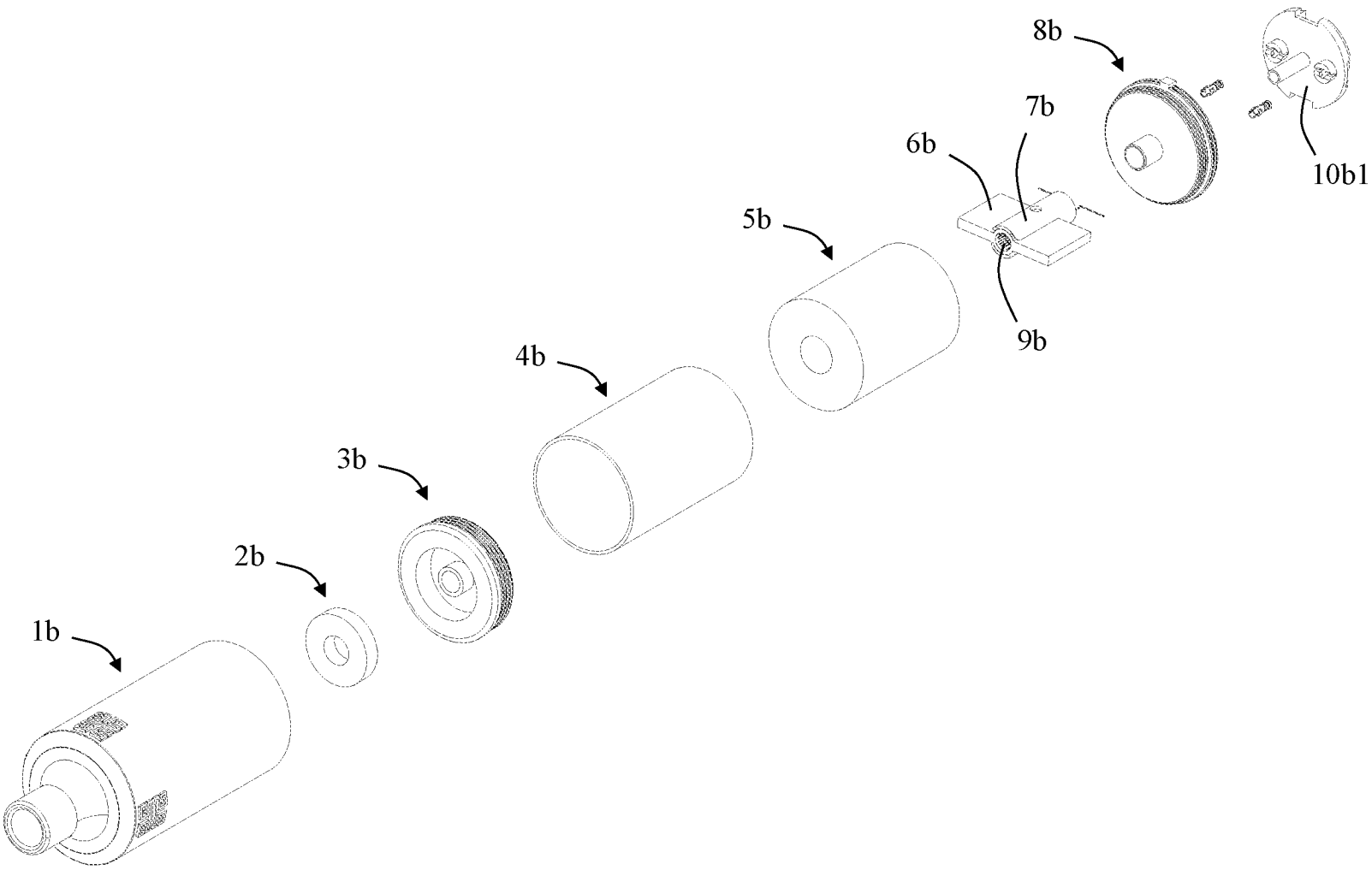
FIG. 22 is a perspective exploded view of FIG. 21 from another angle.
Figure 23:
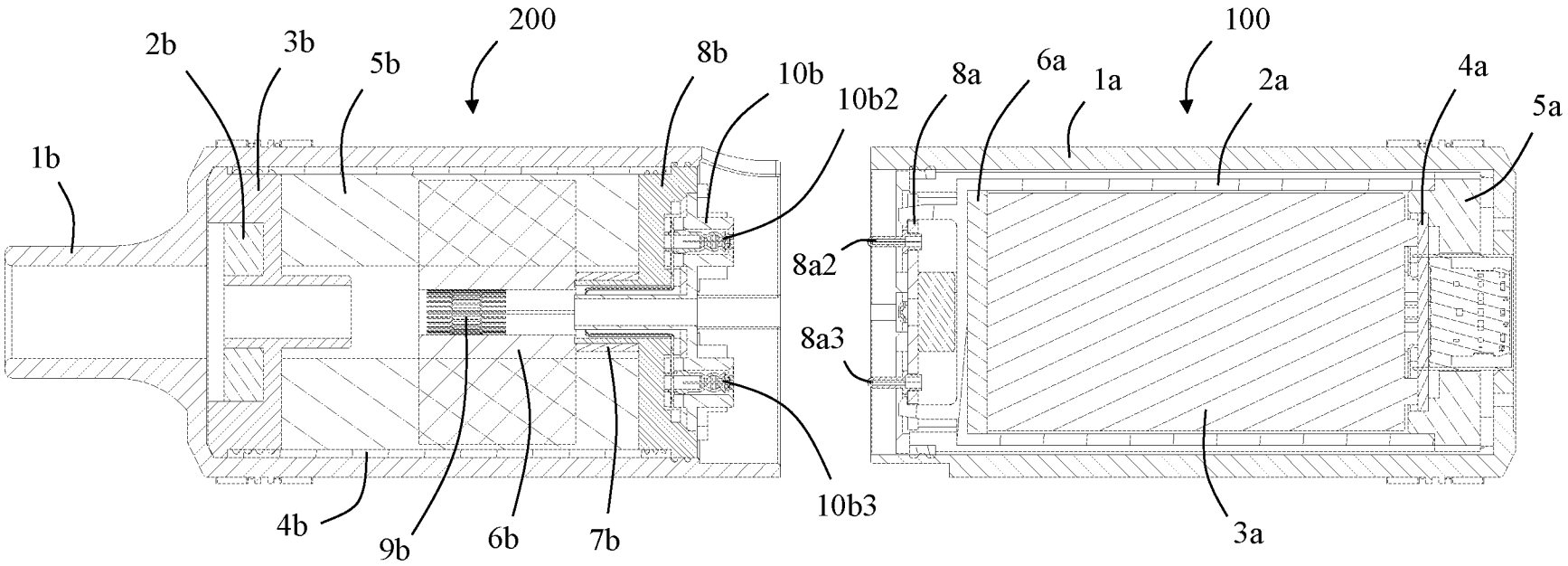
FIG. 23 is a schematic cross-sectional view taken along line A-A in FIG. 3.
Figure 24:
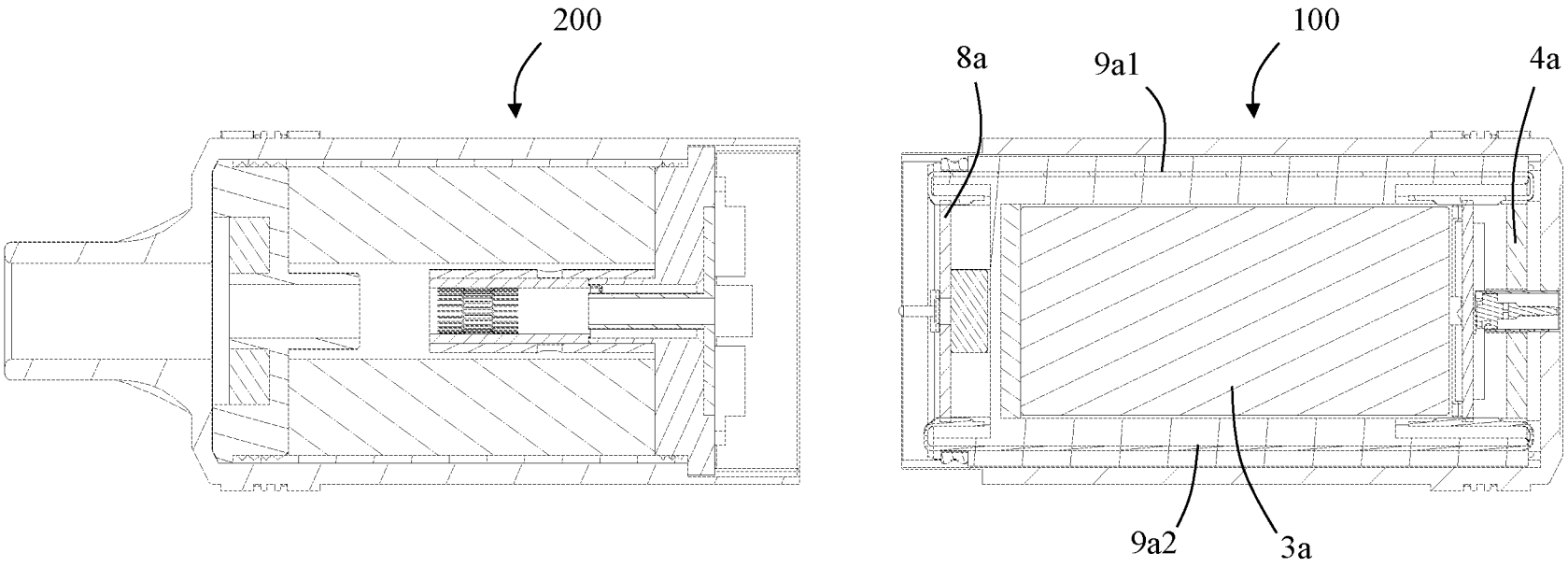
FIG. 24 is a schematic cross-sectional view taken along line B-B in FIG. 4.

In the embodiment shown in the present disclosure, the first mating terminal 8a2 and the second mating terminal 8a3 are directly assembled and fixed to the second circuit board 8a1. Specifically, referring to FIG. 11, the second circuit board 8a1 includes a first hole 8a14 into which the first mating terminal 8a2 is inserted, and a second hole 8a15 into which the second mating terminal 8a3 is inserted. Referring to FIG. 10, the first mating terminal 8a2 and the second mating terminal 8a3 protrude beyond the second circuit board 8a1 along the axial direction toward the electronic atomization heating e-liquid storage assembly 200. Specifically, the first mating terminal 8a2 includes a first plug portion 8a21 protruding beyond the second circuit board 8a1. The first plug portion 8a21 is substantially cylindrical. The second mating terminal 8a3 includes a second plug portion 8a31 protruding beyond the second circuit board 8a1. The second plug portion 8a31 is substantially cylindrical. The first plug portion 8a21 and the second plug portion 8a31 are parallel to each other, and both extend along the axial direction.

Referring to FIGS. 7 to 12, the connecting member 9a includes a first connecting member 9a1 and a second connecting member 9a2. The first connecting member 9a1 connects the first contact element 4a11 of the first circuit board 4a1 and the third contact element 8a11 of the second circuit board 8a1. The second connecting member 9a2 connects the second contact element 4a12 of the first circuit board 4a1 and the fourth contact element 8a12 of the second circuit board 8a1. In this way, the first circuit board 4a1 and the second circuit board 8a1 can be electrically connected. Since the first circuit board 4a1 is connected to the battery 3a, the second circuit board 8a1 is also connected to the battery 3a. That is, the management in the state of charge of the battery 3a can be realized by the first circuit board 4a1. The battery 3a can transmit electric power to the first mating terminal 8a2 in a discharged state, by electrically connecting the first circuit board 4a1 and the second circuit board 8a1 through the first connecting member 9a1 and the second connecting member 9a2.

The first connecting member 9a1 and the second connecting member 9a2 are secured in the battery accommodating housing 2a. In the embodiment shown in the present disclosure, the first connecting member 9a1 and the second connecting member 9a2 are insert-molded in the battery accommodating housing 2a. Of course, in other embodiments, the first connecting member 9a1 and the second connecting member 9a2 may also be assembled to the battery accommodating housing 2a. In the embodiment illustrated in the present disclosure, the first connecting member 9a1 and the second connecting member 9a2 are both metal pieces. Two ends of the first connecting piece 9a1 and two ends of the second connecting piece 9a2 are U-shaped, so that the two ends of the first connecting piece 9a1 and the two ends of the second connecting piece 9a2 have certain elasticity, thereby improving the reliability when contacting the first circuit board 4a1 and the second circuit board 8a1. In the embodiment shown in the present disclosure, the first connecting member 9a1 and the second connecting member 9a2 do not need to be soldered with the first circuit board 4a1 and the second circuit board 8a1, thereby improving the detachability.

Specifically, the first connecting member 9a1 includes a first body portion 9a11, a first bent portion 9a12 bent inwardly and backwardly from one end (e.g., a bottom end) of the first body portion 9a11, and a third bent portion 9a13 bent inwardly and backwardly from another end (e.g., a top end) of the first body portion 9a11. The first bent portion 9a12 and the third bent portion 9a13 are closer to the first circuit board 4a1, so that the reliability of contact is high and the structure is relatively compact. The first bent portion 9a12 and the third bent portion 9a13 are both parallel to the first body portion 9a11. The first body portion 9a11 is insert-molded in the battery accommodating housing 2a. Both the first bent portion 9a12 and the third bent portion 9a13 are exposed in the accommodating space 2a3. Of course, in other embodiments, the first body portion 9a11 can also be embedded or inserted in the battery accommodating housing 2a, so that the first body portion 9a11 can also be fixed to the battery accommodating housing 2a.

Similarly, the second connecting member 9a2 includes a second body portion 9a21, a second bent portion 9a22 bent inwardly and backwardly from one end (e.g., a bottom end) of the second body portion 9a21, and a fourth bent portion 9a23 bent inwardly and backwardly from another end (e.g., a top end) of the second body portion 9a21. The second bent portion 9a22 and the fourth bent portion 9a23 are closer to the second circuit board 8a1, so that the reliability of contact is high and the structure is relatively compact. The second bent portion 9a22 and the fourth bent portion 9a23 are both parallel to the second body portion 9a21. The second body portion 9a21 is insert-molded in the battery accommodating housing 2a. Both the second bent portion 9a22 and the fourth bent portion 9a23 are exposed in the accommodating space 2a3. Of course, in other embodiments, the second body portion 9a21 can also be embedded or inserted in the battery accommodating housing 2a, so that the second body portion 9a21 can also be fixed to the battery accommodating housing 2a.

Referring to FIGS. 7 to 12, FIG. 23 and FIG. 24, after the first circuit board 4a1 and the second circuit board 8a1 are assembled in place, the first bent portion 9a12 is in abutment with the first contact element 4a11, the third bent portion 9a13 is in abutment with the third contact element 8a11, the second bent portion 9a22 is in abutment with the second contact element 4a12, and the fourth bent portion 9a23 is in abutment with the fourth contact element 8a12. In the embodiment shown in the present disclosure, the first bent portion 9a12, the second bent portion 9a22, the third bent portion 9a13 and the fourth bent portion 9a23 are provided with ribs in abutment with the first contact element 4a11, the second contact element 4a12, the third contact element 8a11 and the fourth contact element 8a12, so as to improve the contact reliability.

In an embodiment of the present disclosure, when assembling the electronic atomization heating battery assembly 100, the first mating terminal 8a2 and the second mating terminal 8a3 are assembled with the second circuit board 8a1. The airflow sensing/power control integrated element 8a4 is fixed to the second circuit board 8a1. The control module 8a is assembled to the second end portion 2a2 of the battery accommodating housing 2a. The anti-loosing member 7a is disposed in the annular groove 2a22. The first connecting member 9a1 and the second connecting member 9a2 are fixed to the battery accommodating housing 2a. The elastic gasket 6a is inserted into the accommodating space 2a3 from the first end 2a1 of the battery accommodating housing 2a. The battery 3a is installed into the accommodating space 2a3 from the first end 2a1 of the battery accommodating housing 2a. The battery management module 4a is assembled with the battery fixing and sealing cover 5a, so that the electrical connector 4a2 passes through the through hole Sal of the battery fixing and sealing cover 5a. The assembled battery management module 4a and the battery fixing and sealing cover 5a are installed into the first end portion 2a1 of the battery accommodating housing 2a. Finally, the assembled integral parts are assembled into the first receiving space 1a11 of the first housing 1a.

Compared with the prior art, the battery 3a of the present disclosure can be reused, thereby reducing environmental pollution.

Referring to FIGS. 13 to 22, the electronic atomization heating e-liquid storage assembly 200 includes a second housing 1b, an e-liquid absorbing element 2b, an e-liquid tank upper sealing cover 3b, an e-liquid tank housing 4b, an e-liquid storage element 5b, an e-liquid guiding element 6b, a clamping pipe 7b, an e-liquid tank lower sealing cover 8b, a heating element 9b, and a sealing cover assembly 10b.

Specifically, the second housing 1b includes a mouthpiece 1b1 and a second receiving space 1b2. The engaging recess 201 is formed on the second housing 1b. The e-liquid absorbing element 2b, the e-liquid tank upper sealing cover 3b, the e-liquid tank housing 4b, the e-liquid storage element 5b, the e-liquid guiding element 6b, the clamping pipe 7b, the e-liquid tank lower sealing cover 8b, the heating element 9b, and the sealing cover assembly 10b are all received in the second receiving space 1b2.

In an embodiment of the present disclosure, the e-liquid absorbing element 2b is an e-liquid absorbing cotton. The e-liquid absorbing element 2b is provided with a perforation 2b1 communicating with the mouthpiece 1b1.

In an embodiment of the present disclosure, the e-liquid tank upper sealing cover 3b is a soft rubber sealing cover in order to improve the sealing performance. The e-liquid tank upper sealing cover 3b includes a first channel 3b1 communicating with the perforation 2b1.

In an embodiment of the present disclosure, the e-liquid tank housing 4b is in the shape of a hollow cylinder, and is adapted for refilling e-liquid. The e-liquid tank upper sealing cover 3b is at least partially inserted into the e-liquid tank housing 4b, and is sealed at an upper end of the e-liquid tank housing 4*b*. The e-liquid tank lower sealing cover 8*b* is at least partially inserted into the e-liquid tank housing 4*b*, and is sealed at a lower end of the e-liquid tank housing 4*b*. It should be noted that it is understandable to those skilled in the art that the terminology "seal" used herein refers to preventing the e-liquid from leaking to other places than an e-liquid channel.

The e-liquid storage element 5*b* is adapted for storing e-liquid. In an embodiment of the present disclosure, the e-liquid storage element 5*b* is an e-liquid storage cotton. The e-liquid storage element 5*b* is received in the e-liquid tank housing 4*b*. The e-liquid storage element 5*b* defines a second channel 5*b*1 communicating with the first channel 3*b*1 of the e-liquid tank upper sealing cover 3*b*.

The e-liquid guiding element 6*b* is in contact with the e-liquid storage element 5*b*, so as to guide and absorb the e-liquid derived from the e-liquid storage element 5*b*. In an embodiment of the present disclosure, the e-liquid guiding element 6*b* is an e-liquid guiding cotton. The e-liquid guiding element 6*b* includes a pipe body 6*b*1, a first extension portion 6*b*2 extending from one side of the pipe body 6*b*1, and a second extension portion 6*b*3 extending from another side of the pipe body 6*b*1. The pipe body 6*b*1 is provided with a third channel 6*b*11 communicating with the second channel 5*b*1. The first extension portion 6*b*2 and the second extension portion 6*b*3 are substantially flat.

In an embodiment of the present disclosure, the clamping pipe 7*b* is a hollow metal pipe. The clamping pipe 7*b* is provided with an accommodation space 7*b*1. The clamping pipe 7*b* is of a substantially cylindrical shape. The pipe body 6*b*1 of the e-liquid guiding element 6*b* is received in the accommodation space 7*b*1. The clamping pipe 7*b* includes slots 7*b*2 extending in the axial direction and extending backwardly through an outer wall of the clamping pipe 7*b*. The first extension portion 6*b*2 and the second extension portion 6*b*3 of the e-liquid guiding element 6*b* are inserted into the slots 7*b*2 so as to be assembled with the clamping pipe 7*b*.

In an embodiment of the present disclosure, the e-liquid tank lower sealing cover 8*b* is a soft rubber sealing cover in order to improve the sealing performance. Preferably, the e-liquid tank lower sealing cover 8*b* is inserted into the e-liquid tank housing 4*b* by means of elastic extrusion. In this way, on the premise of not affecting the fixing effect, the e-liquid can be prevented from leaking to the outside as much as possible, and the convenience of assembly and disassembly is also improved.

In an embodiment of the present disclosure, the heating element 9*b* is a heating wire. The heating element 9*b* includes a heating portion 9*b*1, a first connecting wire 9*b*2 connected to the heating portion 9*b*1, and a second connecting wire 9*b*3 connected to the heating portion 9*b*1. The heating portion 9*b*1 is received in the accommodation space 7*b*1 of the clamping pipe 7*b* and/or the pipe body 6*b*1 of the e-liquid guiding element 6*b*. The first connecting wire 9*b*2 and the second connecting wire 9*b*3 pass through the e-liquid tank lower sealing cover 8*b* to extend beyond the e-liquid tank lower sealing cover 8*b*.

In an embodiment of the present disclosure, the sealing cover assembly 10*b* includes a sealing cover 10*b*1, a first contact terminal 10*b*2 fixed to the sealing cover 10*b*1, and a second contact terminal 10*b*3 fixed to the sealing cover 10*b*1. In the embodiment shown in the present disclosure, the first contact terminal 10*b*2 and the second contact terminal 10*b*3 are assembled and fixed in the sealing cover 10*b*1. In the embodiment shown in the present disclosure, the sealing cover 10*b*1 includes a first terminal mounting hole 10*b*11, a second terminal mounting hole 10*b*12, and a positioning post 10*b*13 located between the first terminal mounting hole 10*b*11 and the second terminal mounting hole 10*b*12. The first contact terminal 10*b*2 and the second contact terminal 10*b*3 are inserted into the first terminal mounting hole 10*b*11 and the second terminal mounting hole 10*b*12, respectively. The e-liquid tank lower sealing cover 8*b* is sleeved on the positioning post 10*b*13, so as to improve the assembly precision.

In the embodiment shown in the present disclosure, the first contact terminal 10*b*2 and the second contact terminal 10*b*3 are both of hollow configurations. The first contact terminal 10*b*2 includes a first receiving portion 10*b*21 and a first slit 10*b*22 for holding the first connecting wire 9*b*2. The first receiving portion 10*b*21 has elasticity so as to better accommodate the first plug portion 8*a*21 of the first mating terminal 8*a*2. In the embodiment shown in the present disclosure, the first receiving portion 10*b*21 is provided with a plurality of slots extending along the axial direction. The slots extend through the first receiving portion 10*b*21 in a direction away from the heating element 9*b*, so that the first receiving portion 10*b*21 has a certain elasticity.

Similarly, the second contact terminal 10*b*3 includes a second receiving portion 10*b*31 and a second slit 10*b*32 for holding the second connecting wire 9*b*3. The second receiving portion 10*b*31 has elasticity, so as to better receive the second plug portion 8*a*31 of the second mating terminal 8*a*3. In the embodiment shown in the present disclosure, the second receiving portion 10*b*31 is provided with a plurality of slots extending along the axial direction. The slots extend through the second accommodating portion 10*b*31 in a direction away from the heating element 9*b*, so that the second accommodating portion 10*b*31 has a certain elasticity. In this way, when the electronic atomization heating battery assembly 100 and the electronic atomization heating e-liquid storage assembly 200 are disassembled and then assembled, the first mating terminal 8*a*2 and the second mating terminal 8*a*3 can be reliably contacted with the first contact terminal 10*b*2 and the second contact terminal 10*b*3, respectively, thereby ensuring proper electrical function.

In an embodiment of the present disclosure, when the electronic atomization heating e-liquid storage assembly 200 is assembled, the first contact terminal 10*b*2 and the second contact terminal 10*b*3 are fixed to the sealing cover 10*b*1 to form the sealing cover assembly 10*b*. The first connecting wire 9*b*2 and the second connecting wire 9*b*3 of the heating element 9*b* are clipped into the corresponding first slit 10*b*22 and the second slit 10*b*32. The aforementioned assembly is assembled with the e-liquid tank lower sealing cover 8*b*, so that the heating portion 9*b*1 passes through the e-liquid tank lower sealing cover 8*b*. The clamping pipe 7*b* is sleeved on the heating portion 9*b*1. The e-liquid guiding element 6*b* is inserted into the slot 7*b*2 of the clamping pipe 7*b*. The aforementioned assembly is assembled with the e-liquid storage element 5*b*. The aforementioned assembly is integrally assembled into the e-liquid tank housing 4*b*. The e-liquid tank upper sealing cover 3*b* is assembled into the e-liquid tank housing 4*b*. The e-liquid absorbing element 2*b* is assembled to the e-liquid tank upper sealing cover 3*b*. Finally, the aforementioned assembly is assembled into the second receiving space 1*b*2 of the second housing 1*b*.

When the electronic atomization heating device 300 is in a charging state, the electrical connector 4*a*2 is connected to a mating connector. The battery 3*a* can be charged under the control of the first circuit board 4*a*1.

Figure 25:
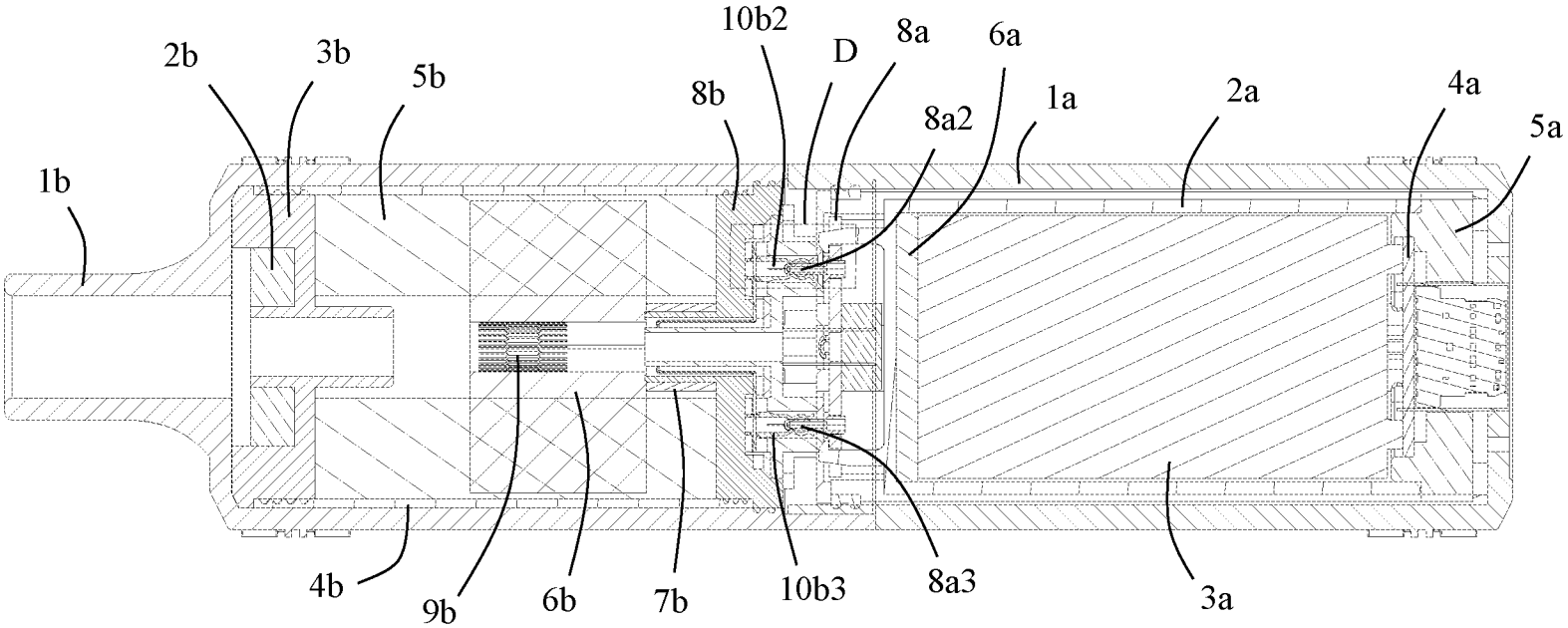
FIG. 25 is a schematic cross-sectional view taken along line C-C in FIG. 1.
Figure 26:
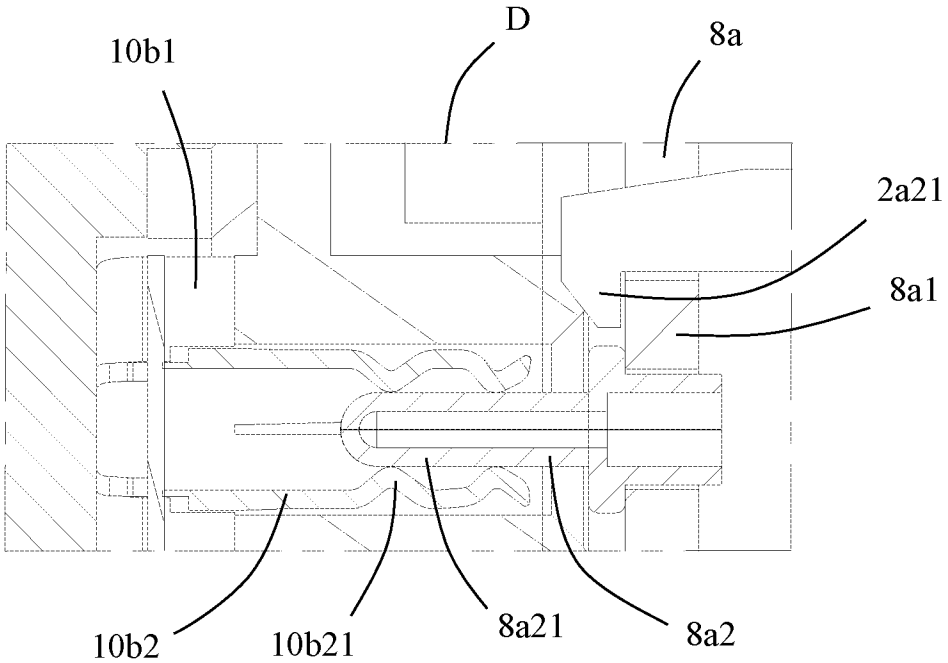
FIG. 26 is a partial enlarged view of a frame portion D in FIG. 25.

Referring to FIGS. 25 and 26, when the electronic atomization heating device 300 is in use, the battery 3*a* is connected through the first circuit board 4*a*1, the first connecting member 9*a*1, the second connecting member 9*a*2, the second circuit board 8*a*1, the first mating terminal 8*a*2, the second mating terminal 8*a*3, the first contact terminal 10*b*2, the second contact terminal 10*b*3, the first connecting wire 9*b*2 and the second connecting wire 9*b*3 so as to provide power to the heating portion 9*b*1. At this time, the heating portion 9*b*1 generates heat and heats the e-liquid. The heated e-liquid is in a gaseous state, and passes through the third channel 6*b*11, the second channel 5*b*1, the first channel 3*b*1 and the perforation 2*b*1 to reach the mouthpiece 1*b*1. The e-liquid storage element 5*b* is capable of storing (e.g., absorbing) e-liquid. The e-liquid guiding element 6*b* is in contact with the e-liquid storage element 5*b*, so that the e-liquid in the e-liquid storage element 5*b* is gradually transferred to the e-liquid guiding element 6*b*, and the e-liquid is heated by the heating portion 9*b*1. With this arrangement, the e-liquid can be fully heated to be in a gaseous state, which avoids heating all the e-liquid at the same time, thereby improving the heating efficiency.

Compared with the prior art, many components of the present disclosure are assembled in a detachable manner, so these components can be reused, which saves costs and reduces pollution. In addition, these components are assembled along the axial direction, so that automatic assembly can be realized more easily, production efficiency can be improved, and installation errors can be reduced.

The above embodiments are only used to illustrate the present disclosure and not to limit the technical solutions described in the present disclosure. The understanding of this specification should be based on those skilled in the art. Descriptions of directions, although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. An electronic atomization heating device, comprising:

an electronic atomization heating battery assembly; and an electronic atomization heating e-liquid storage assembly;

the electronic atomization heating battery assembly comprising:

a first housing having a first receiving space;

a battery accommodating housing received in the first receiving space, the battery accommodating housing having an accommodating space;

a battery detachably received in the accommodating space of the battery accommodating housing;

a battery management module located at one end of the battery;

a control module located at another end of the battery; and a connecting member, the battery management module and the control module being electrically connected to the connecting member;

wherein the electronic atomization heating battery assembly and the electronic atomization heating e-liquid storage assembly are mated with each other;

wherein the battery management module comprises a first circuit board, the first circuit board comprises a first contact element and a second contact element;

the control module comprises a second circuit board, the second circuit board comprises a third contact element and a fourth contact element;

the connecting member comprises a first connecting member and a second connecting member, the first connecting member connects the first contact element of the first circuit board and the third contact element of the second circuit board, and the second connecting member connects the second contact element of the first circuit board and the fourth contact element of the second circuit board;

wherein the first connecting member and the second connecting member are both metal pieces, and two ends of the first connecting member and two ends of the second connecting member are of U-shaped configurations;

wherein the first connecting member comprises a first body portion, a first bent portion bent inwardly and backwardly from one end of the first body portion, and a third bent portion bent inwardly and backwardly from another end of the first body portion; the first bent portion and the third bent portion are both parallel to the first body portion; the first body portion is secured in the battery accommodating housing;

the second connecting member comprises a second body portion, a second bent portion bent inwardly and backwardly from one end of the second body portion, and a fourth bent portion bent inwardly and backwardly from another end of the second body portion; the second bent portion and the fourth bent portion are both parallel to the second body portion; the second body portion is secured in the battery accommodating housing;

the first bent portion is in abutment with the first contact element, the third bent portion is in abutment with the third contact element, the second bent portion is in abutment with the second contact element, and the fourth bent portion is in abutment with the fourth contact element.

2. The electronic atomization heating device according to claim 1, wherein the first contact element and the second contact element are both conductive pads; the first contact element and the second contact element are arranged opposite to each other, and protrude laterally beyond edges of the first circuit board, respectively.

3. The electronic atomization heating device according to claim 1, wherein the third contact element and the fourth contact element are both conductive pads; the third contact element and the fourth contact element are disposed opposite to each other, and protrude laterally beyond edges of the second circuit board, respectively.

* * * * *